US008342504B2

(12) United States Patent
Yamamoto

(10) Patent No.: US 8,342,504 B2
(45) Date of Patent: Jan. 1, 2013

(54) IMAGE FORMING APPARATUS WITH COMMON SUPPORT SHAFT

(75) Inventor: Kiyonori Yamamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 317 days.

(21) Appl. No.: 12/725,736

(22) Filed: Mar. 17, 2010

(65) Prior Publication Data

US 2010/0244360 A1 Sep. 30, 2010

(30) Foreign Application Priority Data

Mar. 30, 2009 (JP) ..... 2009-081499
Mar. 31, 2009 (JP) ..... 2009-084029

(51) Int. Cl.
*B65H 3/44* (2006.01)

(52) U.S. Cl. ..... 271/9.09; 271/127; 399/392; 399/124

(58) Field of Classification Search ..... 271/9.09, 271/126, 127; 399/124, 392
See application file for complete search history.

(56) References Cited

U.S. PATENT DOCUMENTS 4,583,844 A * 4/1986 Honda ..... 271/9.09
4,872,660 A * 10/1989 Kameyama et al. ..... 271/9.09
8,087,658 B2 * 1/2012 Ohtsuki ..... 271/9.09

FOREIGN PATENT DOCUMENTS

| | | | |
|---|---|---|---|
| JP | 3-102038 | | 4/1991 |
| JP | 8-169588 | | 7/1996 |
| JP | 11-091969 | | 4/1999 |
| JP | 11091969 | A * | 4/1999 |
| JP | 2002-214860 | | 7/2002 |
| JP | 2003-307892 | | 10/2003 |
| JP | 2003307892 | A * | 10/2003 |
| JP | 2005-055862 | | 3/2005 |
| JP | 2005-343700 | | 12/2005 |
| JP | 2007-210788 | | 8/2007 |
| JP | 2008083442 | A * | 4/2008 |

* cited by examiner

*Primary Examiner* — Gerald McClain

(74) *Attorney, Agent, or Firm* — Smith, Gambrell & Russell, LLP

(57) ABSTRACT

An image forming apparatus (100) is equipped with a left-side cover (2), manual supply tray (10*b*), a carry guide (31) and a lift plate (33), and these are rotatably supported by a third shaft (35). The apparatus is reduced in size and a protrusion length L of the lift plate (33) is enlarged. The change in inclination angle of the lift plate (33) is reduced and a paper-sheet supply characteristic, even when the amount of paper sheets placed on the manual supply tray (10*b*) changes, is stabilized.

10 Claims, 29 Drawing Sheets

A-A SECTION

B-B SECTION

MOUNTING AND DEMOUNING POSITION (a)

IMAGE FORMING APPARATUS WITH COMMON SUPPORT SHAFT

BACKGROUND OF THE INVENTION

This application is based on Japanese Patent Application No. 2009-084029 filed on Mar. 31, 2009 and No. 2009-081499 filed on Mar. 30, 2009, the contents of which are hereby incorporated by reference.

1. Field of the Invention

The present invention relates to an image forming apparatus such as a digital copy machine, laser printer and the like, and more particularly, to an image forming apparatus that has a mechanism for opening and closing a paper sheet supply tray that is used to carry a sheet to an image forming portion.

2. Description of the Related Art

In some conventional image forming apparatuses, a paper-sheet carry path is formed in a vertical direction by using a carry guide to carry a paper sheet in the vertical direction. Besides, for a resolution process of jam in such a paper-sheet carry path and the like, the carry guide is supported by a shaft to be freely opened and closed, and a side cover that is freely opened and closed is disposed at a position that faces the carry guide which forms the paper-sheet carry path. Besides, in some cases, a manual supply tray (paper-sheet supply tray) is disposed on part of the side cover, and the uppermost surface of paper sheets placed on the manual supply tray is pressurized against a paper-sheet supply roller by a lift plate to perform paper-sheet supply.

In such image forming apparatuses, the carry guide, the side cover and the manual supply tray are not supported by the same support shaft. For example, JP-A-2002-214860 ([1.]) discloses a technology in which that a main component body of a both-side carry unit is formed of a resin and doubles as an exterior cover (side cover), so that the weight of the both-side carry unit and the number of parts are dramatically reduced to simplify the structures of a unit support member and the like, and positional accuracy of a carry roller is raised to allow stable paper-sheet supply. In this patent document [1.] the manual paper-sheet supply unit (paper-sheet supply tray) is supported by a shaft at a position higher than the both-side carry unit (side cover).

Besides, JP-A-2005-343700 ([2.]) discloses a technology in which a paper-sheet carry means that carries a paper sheet upward, an opening panel (side cover) that is disposed on a side of a casing to be freely opened and closed, and a manual supply tray that is disposed to be freely opened at a lower position of the opening panel and able to supply a placed paper sheet to the paper-sheet carry means in a time of being opened are disposed, so that size reduction is achieved and installation space is made small. Besides, in this patent document [2.], the paper-sheet carry means is unitarily formed with the opening panel to be freely opened and closed about a lower end that is used as a pivot; however, the manual supply tray is supported by a shaft at a position lower than the opening panel.

Besides, JP-A-2005-055862 ([3.]) discloses a technology in which first and second cover portions that are rotatable from a closing position to an opening position form first and second carry paths in parallel; a side of the first cover forms part (side cover) of a housing; first and second engagement means engage the first and second cover portions with the apparatus main body; the first engagement means is operated to together with the second engagement means in response to rotation between the closing position and the opening position, so that when a cover member that defines the first and second carry paths is opened or closed, it is possible to smoothly open or close the cover member. In this patent document [3.], a state in which the manual supply tray is supported by a shaft is not disclosed.

On the other hand, in such an image forming apparatus, rotary members such as the carry guide, the side cover, the manual supply tray and the like are rotatably supported in the apparatus main body by using a support shaft as shown in FIG. 17, for example. Specifically, a rear-side end portion 51*a* of a first shaft 51 that is formed into a D shape in section is inserted into a first through-hole 61*a* that is disposed through a rear-side wall 61 and formed into substantially the same shape in section as the rear-side end portion 51*a*; a come-off-preventive stop ring 55 is mounted from outside (left side in the figure) in a shaft direction, so that the rear-side end portion 51*a* is fixed.

Here, a front-side end portion 51*b* protrudes beyond a second through-hole 62*a* that is formed through a front-side wall 62; a first bearing 70 that is inserted onto the front-side end portion 51*b* is inserted into the second through-hole 62*a*; and the stop ring 55 is mounted from outside (right side in the figure) in the shaft direction like in the above description, so that the front-side end portion 51*b* is fixed.

Here, in such a technology, by reducing a clearance between an inner diameter of the first through-hole 61*a* and an outer diameter of the rear-side end portion 51*a*, positional accuracy of the first shaft 51 is raised. Accordingly, an inner diameter of the second through-hole 62*a* through which the first shaft 51 penetrates at the front-side side wall 62 is enlarged, so that it is made easy to insert the first shaft 51 from the front-side wall 62 to the rear-side wall 61 in a time of assembly and easy to insert the rear-side end portion 51*a* into the first through-hole 61*a*. And, the first bearing 70 through which the front-side end portion 51*b* penetrates is inserted into the second through-hole 62*a*, so that the first shaft 51 is supported.

However, because the above stop ring is used, the number of parts increases and mounting tools become necessary. Besides, because both end portions of the support shaft are situated in small places, that is, the front-side and rear-side end portions of the apparatus main body, it is hard to mount the stop ring and the like. To avoid this, a technology for fixing the bearing without using the stop ring is proposed.

For example, JP-A-1996-169588 ([4.]) discloses a technology in which two come-off-preventive protrusion portions for bearings are inserted into oblong bearing support openings (holes) formed through support walls until a state in which the come-off-preventive protrusion portions engage with side walls of the oblong bearing support openings to be prevented from coming off; a snap fit portion and an engagement portion formed on the support wall are snap-fitted to each other to prevent the bearing from rotating in a shaft rotation direction, so that with a simple structure and without using special tools and parts, the mounting and demounting of the shaft are made possible and the operability is improved at low cost.

SUMMARY OF THE INVENTION

As described above, the patent documents [1.] to [3.] do not disclose that the manual supply tray is supported by the same shaft as that for the side cover and the carry guide such as the both-side carry unit and the like. Here, in a case where the manual supply tray is supported by the same shaft as that for the carry guide and the side cover, it is thought that it becomes possible to achieve size reduction of the apparatus main body and decrease the number of parts.

However, the carry guide, the manual supply tray and the open/close cover are usually mounted successively from inside to outside of the apparatus main body. Further, to achieve size reduction of the apparatus main body, the assembly space also becomes small; accordingly, in some cases, in consideration of easy assembly and the like, the lift plate is mounted on the apparatus main body after the carry guide is mounted and before the manual supply tray is mounted.

In such a case, as shown in FIG. 18, for example, the manual supply tray 10*b* that constitutes part of a paper-sheet supply mechanism 10 is supported by the first shaft 51; and a lift plate 33 is supported by a second shaft 52 that is disposed at a more inside position (right side) than the first shaft 51. Like this, because the lift plate 33 is supported more inside than the manual supply tray 10*b*, a protrusion length L of the lift plate 33 from the second shaft 52 to a downstream position (right side in the figure) in a paper-sheet supply direction becomes short (see FIG. 19). Especially, the smaller the apparatus main body becomes, the shorter the protrusion length L becomes.

And, as shown in FIG. 19, when the protrusion length L becomes short, the rotation angle of the lift plate 33 considerably changes depending on whether a small number of paper sheets are placed on the manual supply tray 10*b* (solid line in the figure) or a large number of paper sheets are placed on the manual supply tray 10*b* (broken line in the figure), and the approach angle of a paper sheet to a paper-sheet supply roller 45 considerably changes, so that it becomes hard to stabilize the paper-sheet carry characteristic. Besides, in a case where a pivot shaft for the lift plate 33 is disposed separately from the first shaft 51, the number of parts increases, thereby probably bringing about weight increase, cost increase, and extension in assembly time.

On the other hand, in the technology in the above patent document 4, because the support hole for the bearing has a different diameter, it is hard to insert the bearing into the support hole. Besides, because it is necessary to sandwich the side wall by using the come-off-preventive protrusion portion, it becomes hard to sandwich the side wall when the side wall is especially thick. Accordingly, in supporting the support shaft in the apparatus main body, it is desirable to use a bearing that allows size reduction of the apparatus main body and is capable of freely being mounted and demounted in and from the apparatus main body with ease even in a place where it is hard to work without using additional parts and tools.

The present invention has been made to deal with the conventional problems, and it is an object of the present invention to provide an image forming apparatus that is capable of achieving size reduction of the apparatus main body and stabilizing paper-sheet supply performance without complicating the apparatus main body and with a simple structure.

To achieve the above object, the present invention is an image forming apparatus that includes:

a side cover which constitutes part of an apparatus main body and is rotatably supported at a lower end portion thereof to be freely opened and closed;

a paper-sheet supply tray that is used to place a paper sheet thereon, constitutes part of the side cover, and supported rotatably at a lower end portion thereof to be freely opened and closed from and to the side cover;

a paper-sheet pushing-up plate that is supported rotatably at an upstream end portion in a paper-sheet carry direction thereof, capable of pressurizing and separating the paper sheet placed on the paper-sheet supply tray to and from a paper-sheet carry roller that is disposed in the apparatus main body;

a carry guide that is disposed along an inner surface of the side cover, supported rotatably at a lower end portion thereof, and forms a paper-sheet carry path for guiding upward the paper sheet, which is carried from the paper-sheet supply tray by the paper-sheet carry roller, in a vertical direction;

wherein at least the side cover, the paper-sheet supply tray and the paper-sheet pushing-up plate are supported by a same support shaft.

According to this structure, at least the side cover, the paper-sheet supply tray and the paper-sheet pushing-up plate are supported by the same support shaft, so that it is possible to achieve size reduction of the apparatus without complicating the apparatus and with a simple structure. Besides, because the paper-sheet pushing-up plate is able to rotate about the same rotation pivot as that for the side cover and the paper-sheet supply tray, it is possible to enlarge the protrusion length of the paper-sheet pushing-up plate and reduce the change in inclination angle of the paper-sheet pushing-up plate in both cases where a large number of paper sheets are placed on the paper-sheet supply tray and a small number of paper sheets are placed on the paper-sheet supply tray. Accordingly, it is possible to achieve size reduction of the apparatus main body and stabilize paper-sheet supply performance.

Besides, in the image forming apparatus having the above structure according to the present invention, the carry guide is supported by the support shaft.

According to this structure, in the image forming apparatus having the above structure, the carry guide is supported by the support shaft, so that it is possible to achieve further size reduction of the apparatus main body.

Besides, the image forming apparatus having the above structure according to the present invention includes a ground member that electrically grounds an electrically conductive member that is disposed on the carry guide via the support shaft.

According to this structure, the image forming apparatus having the above structure includes the ground member that electrically grounds the electrically conductive member that is disposed on the carry guide via the support shaft, so that it is possible to achieve a reduction in the number of parts and an efficient assembly operation without disposing separately another complicated ground member.

Besides, the image forming apparatus having the above structure according to the present invention includes: a limit member that limits opening of the side cover and the carry guide to a predetermined first area; wherein the side cover and the carry guide are capable of being opened to a second area beyond the first area in response to limitation release of the limit member and freely mounted and demounted on and from the support shaft with opened to the second area.

According to this structure, the image forming apparatus having the above structure according to the present invention includes: the limit member that limits opening of the side cover and the carry guide to the predetermined first area; wherein the side cover and the carry guide are capable of being opened to the second area in response to limitation release of the limit member and freely mounted and demounted on and from the support shaft with opened to the second area, so that an efficient assembly operation is achieved and the maintenance operation also becomes easy.

Besides, in the image forming apparatus having the above structure according to the present invention, the support shaft is capable of being mounted in the apparatus main body with at least one of the paper-sheet supply tray and the paper-sheet pushing-up plate mounted on the support shaft.

According to this structure, it is possible to achieve an efficient assembly operation for mounting the paper-sheet supply tray or the paper-sheet pushing-up plate, and the support shaft that supports the paper-sheet supply tray and the paper-sheet pushing-up plate in the apparatus main body.

Besides, in the image forming apparatus having the above structure according to the present invention, one end of the support shaft is supported by the apparatus main body and the other end of the support shaft is supported by a bearing member which is mounted from outside of the apparatus main body, and the support shaft is mounted in the apparatus main body with movements in a shaft direction and a rotation direction limited.

According to this structure, in the operation for mounting the support shaft in the apparatus main body, because it is possible to bring the support shaft into a fixed state and a state in which the support shaft is mountable or demountable, the number of parts is decreased, an efficient assembly operation is achieved and the maintenance operation also becomes easy.

Besides, in the image forming apparatus having the above structure according to the present invention, the bearing member includes:

a main body portion that is disposed in the apparatus main body and includes a cylindrical member capable of being freely mounted and demounted in and from a support hole through which the support shaft penetrates;

a flange portion that protrudes from a separation-side end portion of an outer circumferential surface of the main body portion and is capable of limiting movement of the main body portion toward a mounting side of the main body portion;

a butt portion that prevents the support shaft from falling off the main body portion, protrudes from an inner circumferential surface of the main body portion and is capable of butting against one end portion of the support shaft; and an engagement pawl portion that prevents the main body portion from falling off the apparatus main body and is formed along a longitudinal direction of the main body portion by providing cutouts in the main body portion from the flange portion to a central portion substantially in parallel to and a predetermined distance away from each other;

wherein a protrusion end portion of the engagement pawl portion constitutes part of the flange portion and is capable of engaging with an engagement portion that is formed in the apparatus main body; and in a time the bearing member is mounted or demounted on or from the apparatus main body, the engagement pawl portion bends toward an inner circumferential side of the main body portion, so that the protrusion end portion is engaged with or disengaged from the engagement portion.

According to this structure, the support shaft is supported in the apparatus main body by the bearing member; the flange portion, the butt portion and the engagement pawl portion are formed on the main body portion of the bearing member; the protrusion end portion of the engagement pawl portion constitutes part of the flange portion and is capable of engaging with the engagement portion that is formed in the apparatus main body; and the engagement pawl portion bends toward the inner circumferential side of the main body portion in a time the bearing member is mounted or demounted on the apparatus main body to engage or disengage the protrusion end portion with or from the engagement portion, so that it becomes possible to achieve easy mounting and demounting on and from the apparatus main body even in a place where it is hard to work without using additional members and tools. Besides, the cost reduction and resource conservation are achieved.

Besides, in the image forming apparatus having the above structure according to the present invention, a limit portion that is capable of limiting flexure of the engagement pawl portion toward the inner circumferential side protrudes from the inner circumferential surface of the main body portion.

According to this structure, in the image forming apparatus having the above structure, the limit portion that is capable of limiting flexure of the engagement pawl portion toward the inner circumferential side protrudes from the inner circumferential surface of the main body portion, so that it is possible to prevent the engagement pawl portion from excessively bending to break down when the bearing member is mounted or demounted.

Besides, in the image forming apparatus having the above structure according to the present invention, an outer diameter of the protrusion end portion becomes larger from one end portion to the other end portion in a circumferential direction.

According to this structure, in the image forming apparatus having the above structure, by enlarging the outer diameter of the protrusion end portion from one end portion to the other end portion in the circumferential direction, it is possible to disengage the protrusion end portion from the engagement portion by only rotating the bearing member in one direction, so that the workability improves.

Besides, in the image forming apparatus having the above structure according to the present invention, the main body portion is capable of rotatably supporting the side cover, the paper-sheet supply tray, the paper-sheet pushing-up plate or the carry guide.

According to this structure, in the image forming apparatus having the above structure, by allowing the main body portion to rotatably support the side cover, the paper-sheet supply tray, the paper-sheet pushing-up plate or the carry guide, the member is able to be shared, so that it is possible to further reduce the number of parts.

DESCRIPTION OF THE PREFERRED EMBODIMENTS

Figure 1:
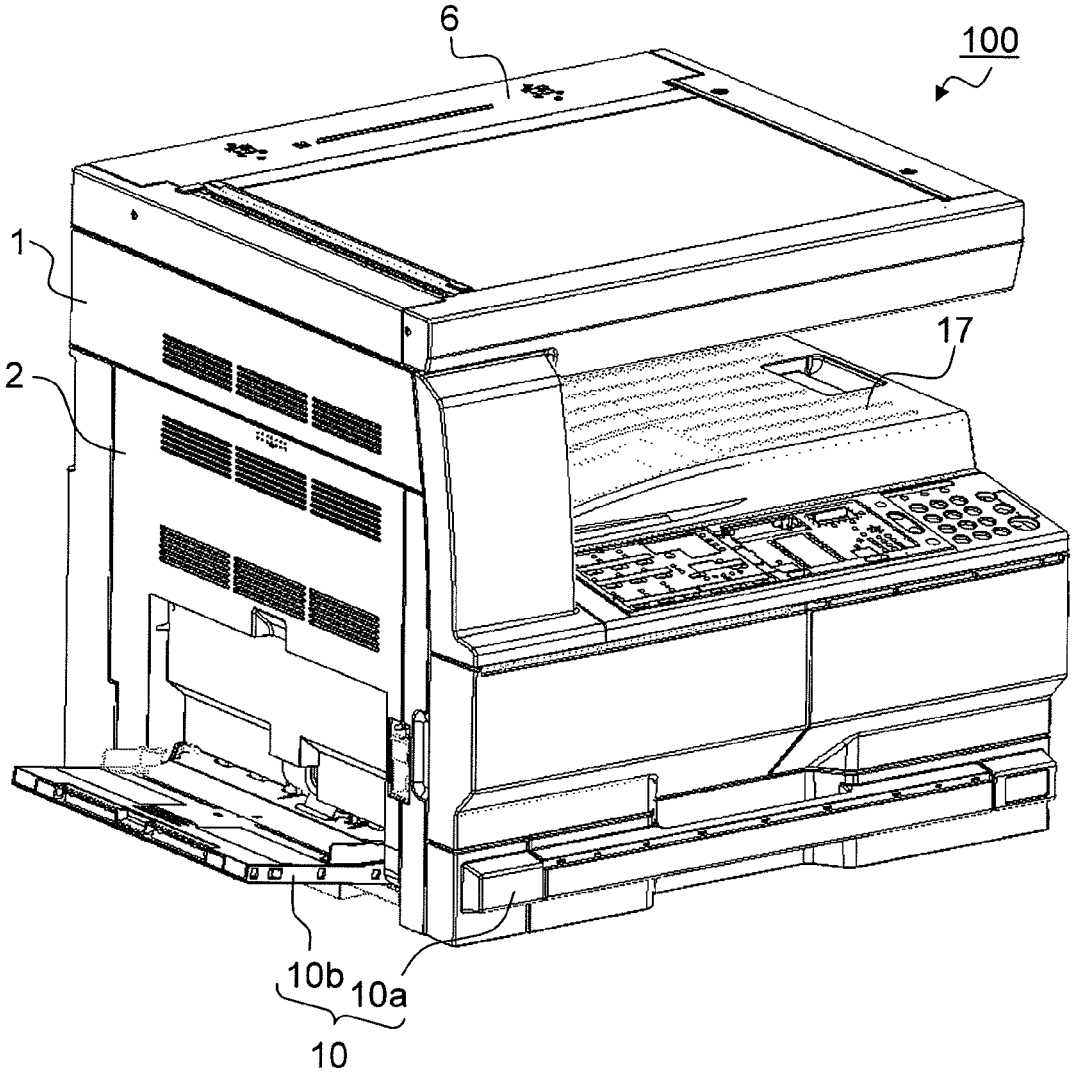
FIG. 1 is a schematic view of an image forming apparatus according to a first embodiment of the present invention.
Figure 2A:
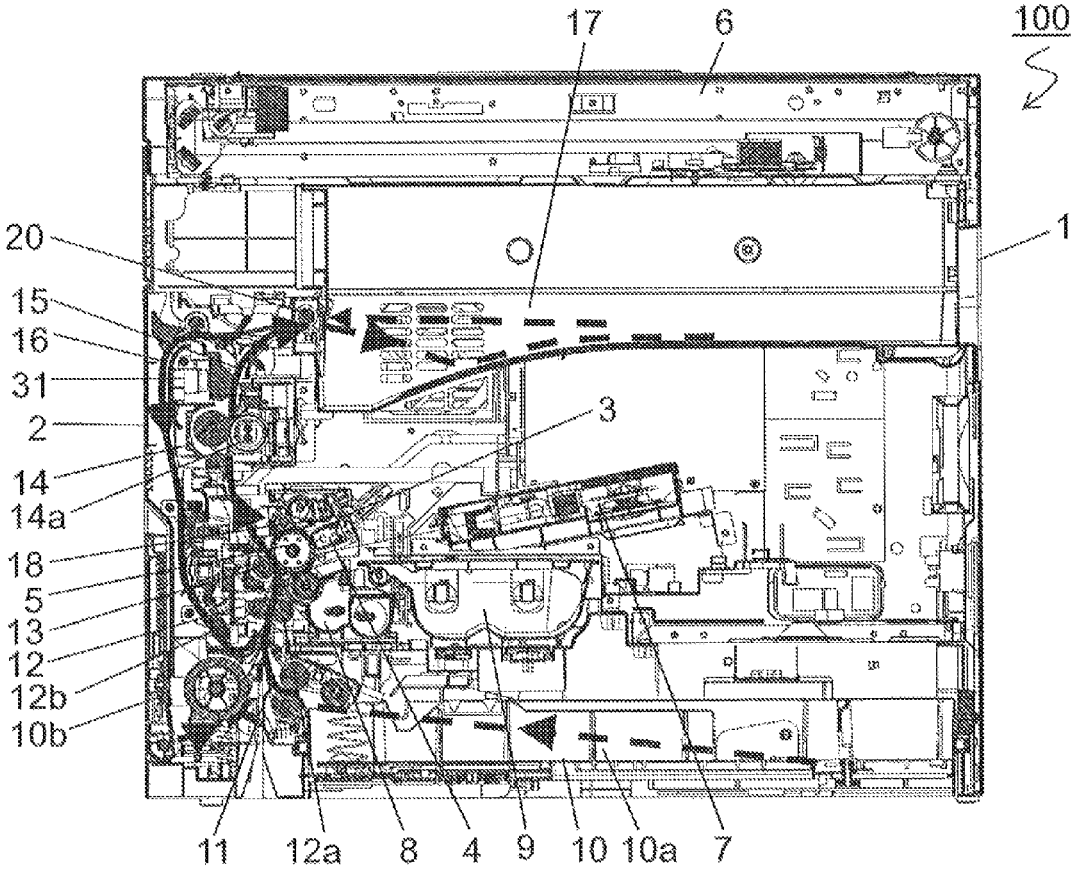
FIG. 2A is a sectional view of a schematic structure seen from a front in FIG. 1.
Figure 2B:
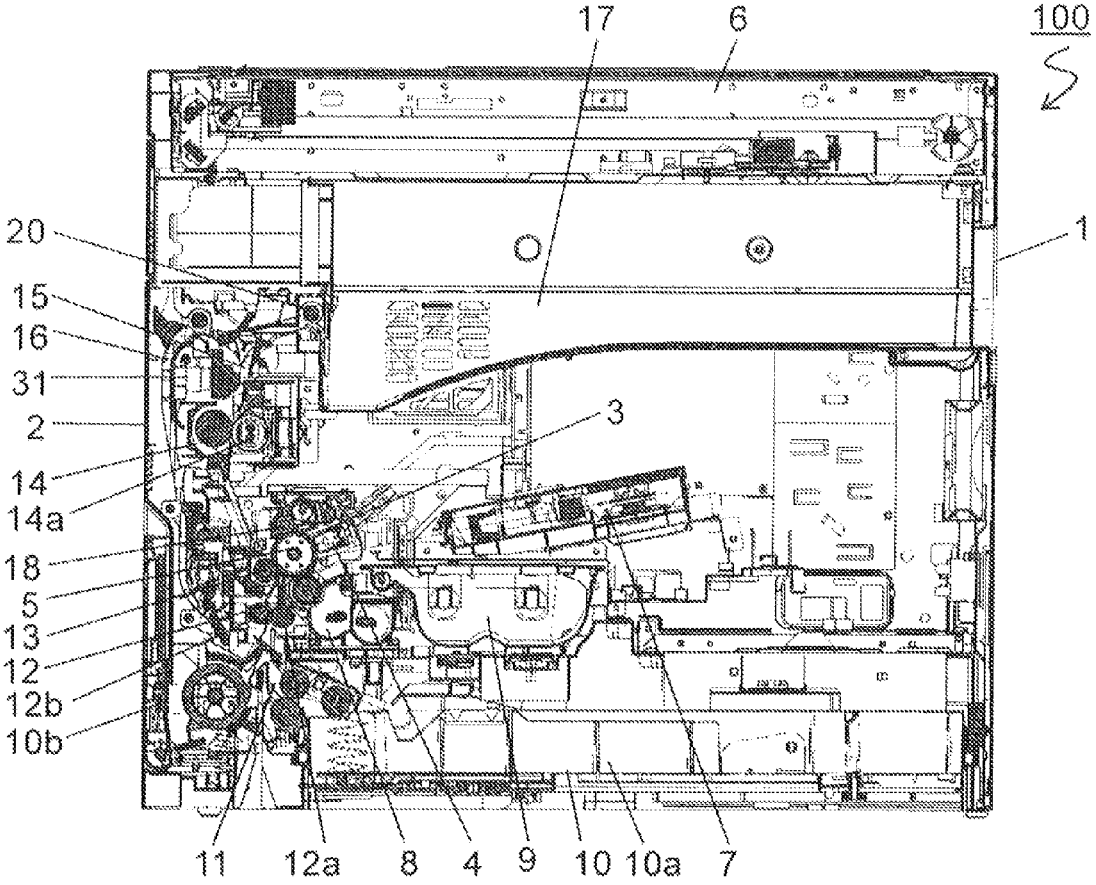
FIG. 2B is the same view as FIG. 2A except without the paper carry direction lines shown.
Figure 18:
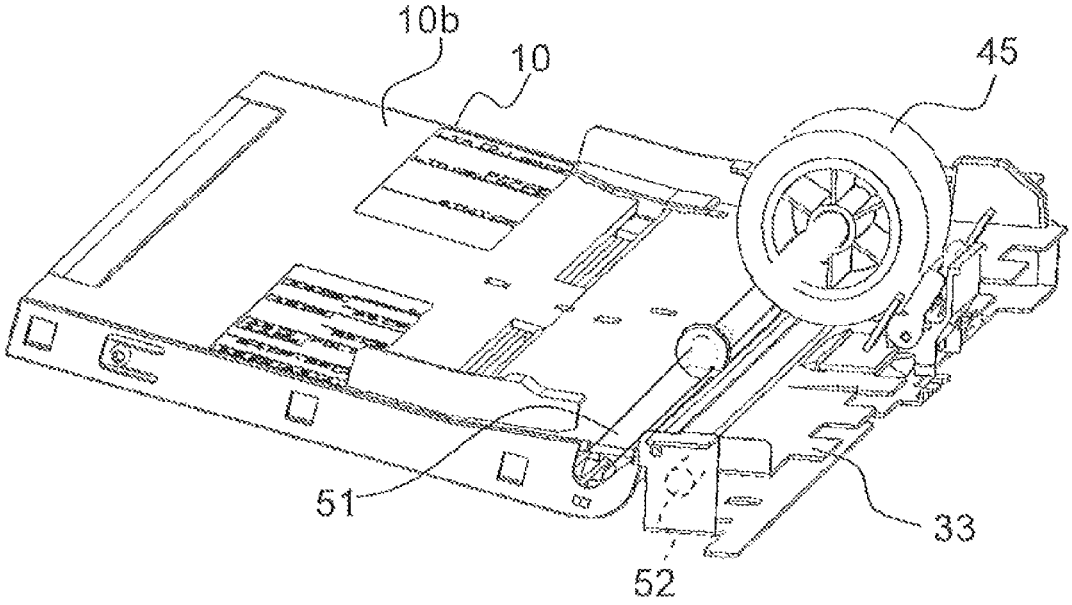
Fig. 18 CONVENTIONAL ART
FIG. 18 is a perspective view showing dispositions of a manual supply tray and a lift plate in a conventional image forming apparatus.
Figure 19:
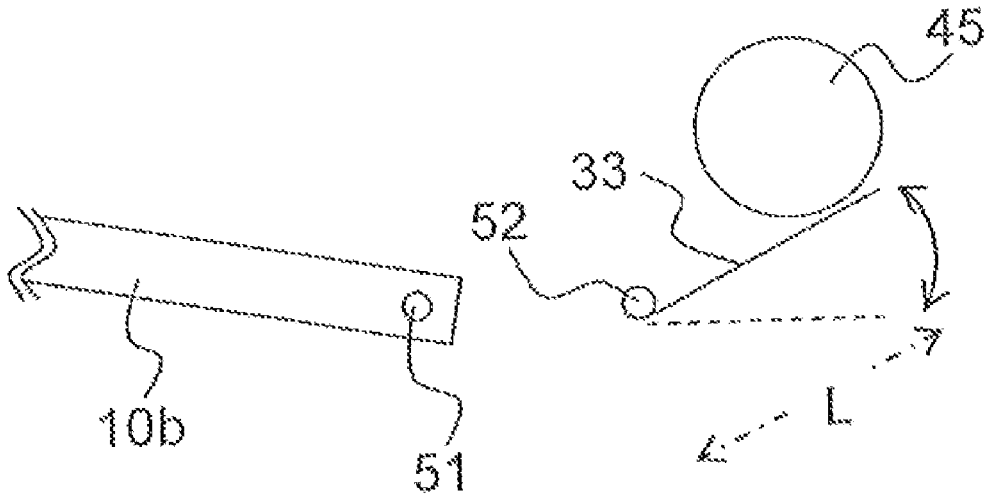
Fig. 19 CONVENTIONAL ART
FIG. 19 is a view showing an inclination state when a paper sheet on a lift plate in a conventional image forming apparatus is pressurized against a paper-sheet supply roller.

Hereinafter, the embodiments of the present invention are described with reference to the drawings. FIG. 1 is an appearance view of an image forming apparatus according to a first embodiment of the present invention. FIG. 2 is a sectional view showing a schematic structure seen from a front in FIG. 1. In FIGS. 1 and 2, a reference number 100 indicates an image forming apparatus 100, and here, shows a digital multi-function machine. In FIG. 2, carry directions of a paper sheet is shown by a solid line and a broken line. Besides, in FIGS. 1 and 2, portions common to FIGS. 18 and 19 are indicated by common reference numbers and description of them is skipped.

As shown in FIGS. 1 and 2, in the image forming apparatus 100, to perform a copy operation, in an image forming portion 3 of a multi-function machine main body 1, a small-diameter photoreceptor drum 5 that rotates clockwise in the figure is evenly electrified by an electrification unit 4; an electrostatic latent image is formed on the photoreceptor drum 5 by a laser beam from an exposure unit (laser scan unit or the like) 7 that is based on document image data read by an image read portion 6; developer (hereinafter, called toner) is made adhere to the electrostatic latent image by a development unit 8 to form a toner image. Toner is supplied to the development unit 8 from a toner container 9.

As described above, toward the photoreceptor drum 5 on which the toner image is formed, a paper sheet is guided from a paper-sheet supply mechanism 10 by a first paper-sheet carry path (paper-sheet carry path) 11 (shown by a solid-line portion in FIG. 2 and an arrow shows the carry direction) to the image forming portion 3 via a pair of resist rollers 12 that include a drive roller 12*a* and a driven roller 12*b*; in the image forming portion 3, the toner image on a surface of the photoreceptor drum 5 is transferred to the paper sheet by a transfer roller 13. And, the paper sheet to which the toner image is transferred is separated from the photoreceptor drum 5, guided by a carry guide 31 and carried to a fixing device 14 that includes a pair of fixing rollers 14*a*, so that the toner image is fixed.

The paper sheet that passes through the fixing device 14 is sent to a second paper-sheet carry path 15 (shown by a solid line in FIG. 2 and an arrow shows the carry direction), and ejected to a paper-sheet ejection portion of a ejection tray 17 via a pair of ejection rollers 20 as it is (or after being sent to a both-side carry path 16 to undergo both-side coping). Besides, although not shown in the figure, an electricity removal apparatus that removes electric charges remaining on the surface of the photoreceptor drum 5 is disposed in a downstream side with respect to a cleaning apparatus 18.

Further, the paper-sheet mechanism 10 includes a paper-sheet supply cassette 10*a* that is removably mounted in the multi-function machine main body and stores paper sheets and a manual supply tray (paper-sheet supply tray) 10*b* that is disposed above the paper-sheet supply cassette 10*a*, which are connected to the image forming portion 3 that includes the photoreceptor drum 5, the development unit 8 and the like via the first paper-sheet carry path 11.

An outer (left side in FIG. 2) surface of the first paper-sheet carry path 11 is formed by an upward rotation of the carry guide 31 that is rotatable in a vertical direction. In the carry guide 31, the driven roller 12*b* of the pair of resist rollers 12 and the transfer roller 13 are rotatably disposed; and a guide member 31*c* (see FIG. 6) that is made of metal and electrically conductive is disposed in a downstream side with respect to the transfer roller 13 in the first paper-sheet carry path 11. The transfer roller 13 and the guide member 31*c* are electrically grounded by a ground member 31*d* described later. The carry guide 31 rotates downward to open the paper-sheet carry path 11, so that it is possible to perform a jam resolution process and the like. It is also possible to provide the image read portion 6 with a platen (document pusher) that pushes and holds a document placed.

The both-side carry path 16 communicates with an upstream side with respect to the ejection roller 20 in the second paper-sheet path 15. The both-side carry path 16 is a route in which a paper sheet on one side of which an image is formed is switched back by the ejection roller 20 and carried, and is formed of the outer (left side in FIG. 2) surface of the carry guide 31 and the inner (right side in FIG. 2) surface of the left side cover 2. The paper sheet switched back is guided by the both-side carry path 16, an image is formed on the other side again by the image forming portion 3, and ejected (both-side copy).

Figure 3:
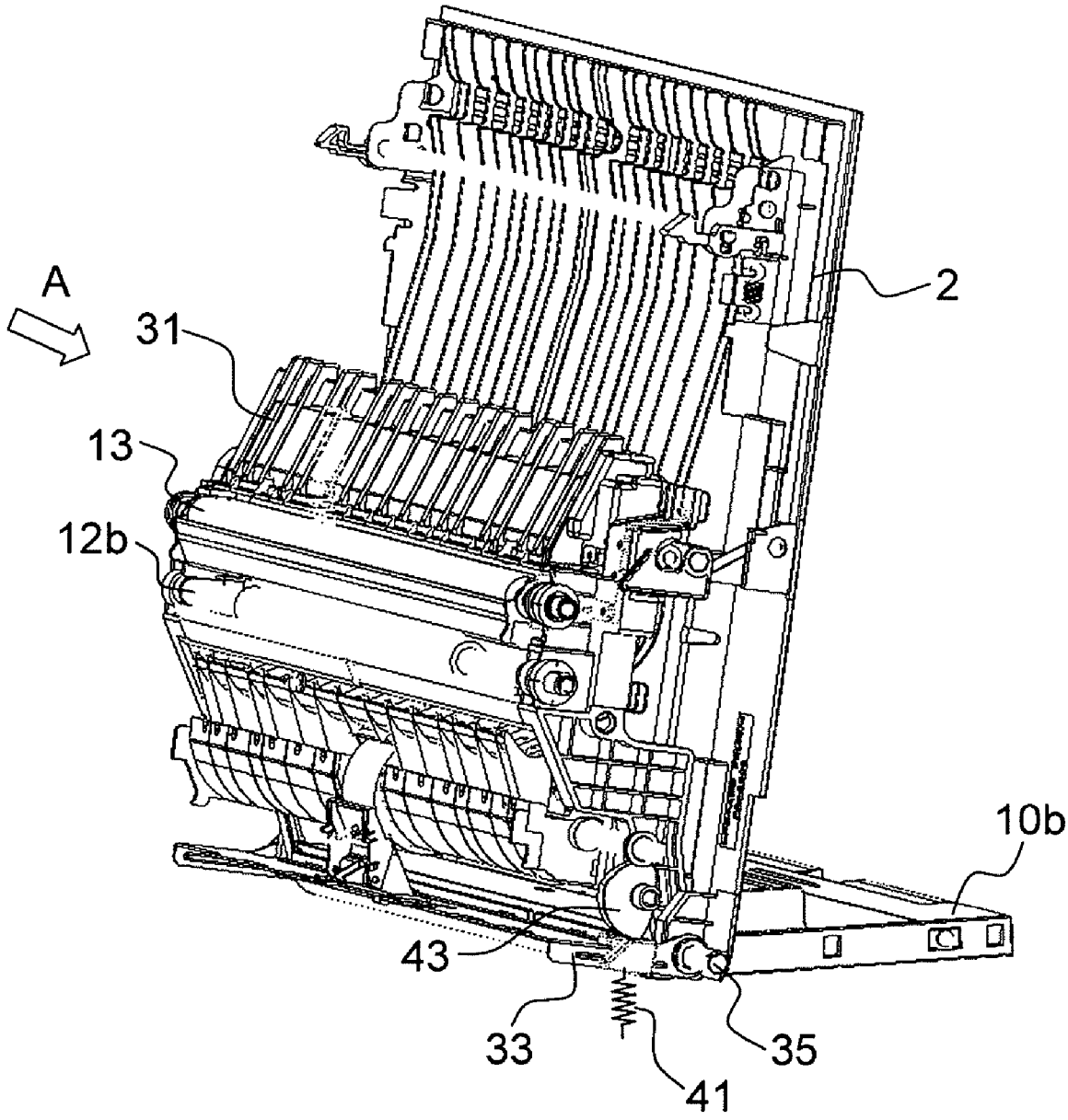
FIG. 3 is a partial perspective view of a carry guide, a left side cover, a manual supply tray and a lift plate that are used in the image forming apparatus according to the present invention and seen from inside.
Figure 4:
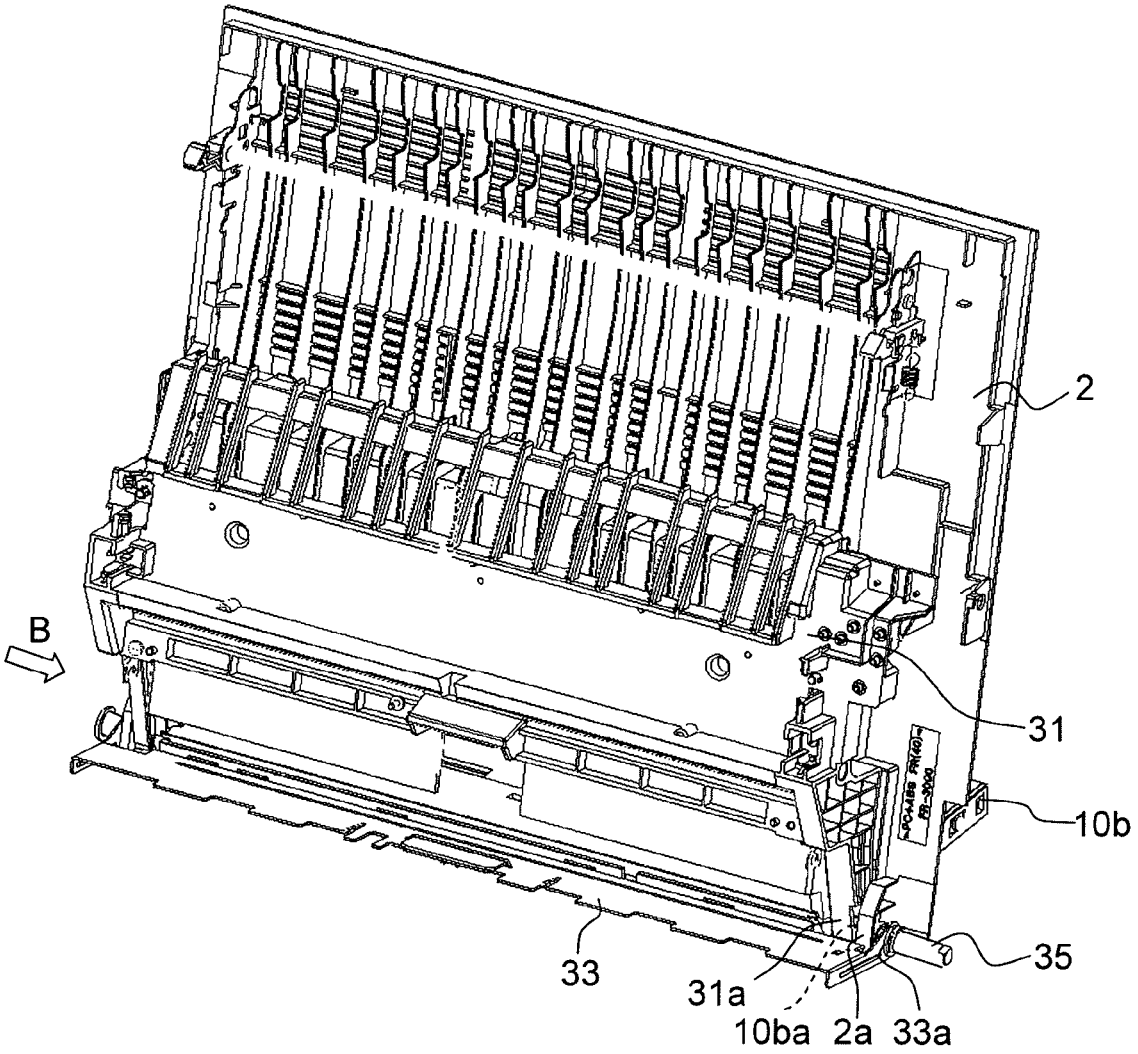
FIG. 4 is a partial perspective view seen from an A direction in FIG. 3.

FIG. 3 is a partial perspective view of the carry guide, the left side cover, the manual supply tray and the lift plate that are used in the image forming apparatus according to the present embodiment and seen from inside; FIG. 4 is a partial perspective view seen from an A direction in FIG. 3. Portions common to FIGS. 1, 2, 18 and 19 are indicated by common reference numbers and description of them is skipped. Here, in FIGS. 3 and 4, a perspective view seen from a rear side of the apparatus main body is shown. Besides, in FIG. 4, the driven roller 12*b* of the pair of resist rollers 12 and the transfer roller 13 are not shown.

As shown in FIGS. 3 and 4, behind the left side cover (side cover) 2 (see FIG. 1) of the apparatus main body, the manual supply tray 10*b*, the carry guide 31 and the lift plate (paper-sheet pushing-up plate) 33 are disposed. Besides, a third shaft (support shaft) 35 is a metal shaft member and disposed in a front-to-rear direction of the apparatus main body. At both end portions in a longitudinal direction at a lower end portion of the left side cover 2, first engagement portions 2*a* that each have substantially a C shape in section are formed to protrude. The first engagement portion 2*a* is fitted to the third shaft 35, so that the left side cover 2 is able to rotate to outward about the third shaft 35 as a pivot.

In the manual supply tray 10*b*, a lower member 10*bb* and an upper member 10*bc* (see FIGS. 5B and 5C) that are formed of a resin material are fastened to each other by a fit-in member (not shown) that is freely mounted and demounted, and the manual supply tray 10*b* is able to be housed in the left side cover 2 to constitute part of the left side cover 2. Besides, at both end portions in a longitudinal direction at a lower end portion of the lower member 10*bb* of the manual supply tray 10*b*, second engagement portions 10*ba* that each have substantially a U shape in section are recessed and formed. The second engagement portions 10*ba* are fitted to the third shaft 35 at more inside positions than the left side cover 2, so that the manual supply tray 10*b* is able to rotate to outward about the third shaft 35 as the pivot.

When the manual supply tray 10*b* rotates outward, the lower member 10*bb* butts against and is supported by a lower cover (not shown) that is disposed at a lower portion of the apparatus main body, inclines and protrudes slightly upward from the left side cover 2 with respect to a horizontal line; a paper sheet is placed on the manual supply tray 10*b* and a tip end portion of the paper sheet is placed on the lift plate 33 descried later. On the other hand, when the manual supply tray 10*b* rotates inward, the manual supply tray 10 is able to be housed in the left side cover 2.

The carry guide 31 is disposed substantially in parallel to the left side cover 2 along a vertical direction; and at both end portions in a longitudinal direction at a lower end portion of the carry guide 31, third engagement portions 31*a* that each have substantially a C shape in section are formed to protrude. The third engagement portions 31*a* are fitted to the third shaft 35 at more outside positions than the second engagement portions 10*ba* of the manual supply tray 10*b*, so that the carry guide 31 is able to rotate to outward about the third shaft 35 as a pivot.

And, the lift plate 33 is a sheet metal member and is disposed substantially perpendicularly to the carry guide 31; and at both end portions in a longitudinal direction at an upstream-side end portion of the lift plate 33 in a paper-sheet carry direction, a side plate portion that is provided with fourth engagement portions 33*a* that each have substantially a C shape in section are formed to protrude. The fourth engagement portions 33*a* are inserted onto the third shaft 35 to mount second bearings 33*b* (see FIG. 5), so that the lift plate 33 is able to rotate about the third shaft 35 as the pivot. Besides, the lift plate 33 protrudes inward from the third shaft 35 and is disposed in such a way that when the manual supply tray 10*b* rotates outward, the lift plate 33 becomes substantially parallel to the manual supply tray 10*b*. Besides, a coil spring 41 (see FIG. 7) is disposed between a lower surface of the lift plate 33 and the apparatus main body, and the lift plate 33 is always energized upward.

Next, an operation for mounting these members into the apparatus main body is described in detail by using FIG. 5. FIG. 5A is a view schematically showing a state seen from over in which the support shaft is mounted on a frame body of the apparatus main body and each member is supported by the support shaft; FIG. 5B is a sectional view along an A-A line in FIG. 5A; FIG. 5C is a sectional view along a B-B line in FIG. 5A; FIG. 5D is a sectional view along a C-C line in FIG. 5A and shows a use state; and FIG. 5E is a view showing a state in which the carry guide (or the left side cover) rotates to a mounting and demounting position from the state in FIG. 5D to be separated.

Figure 5A:
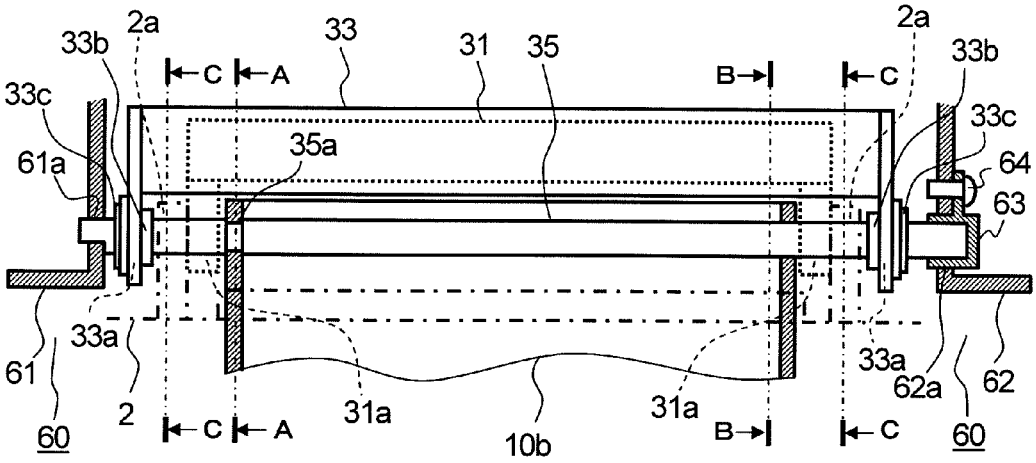
FIG. 5A is a view schematically showing a state seen from over in which a support shaft is mounted on a frame body of an apparatus main body and each member is supported by the support shaft.
Figure 5B:
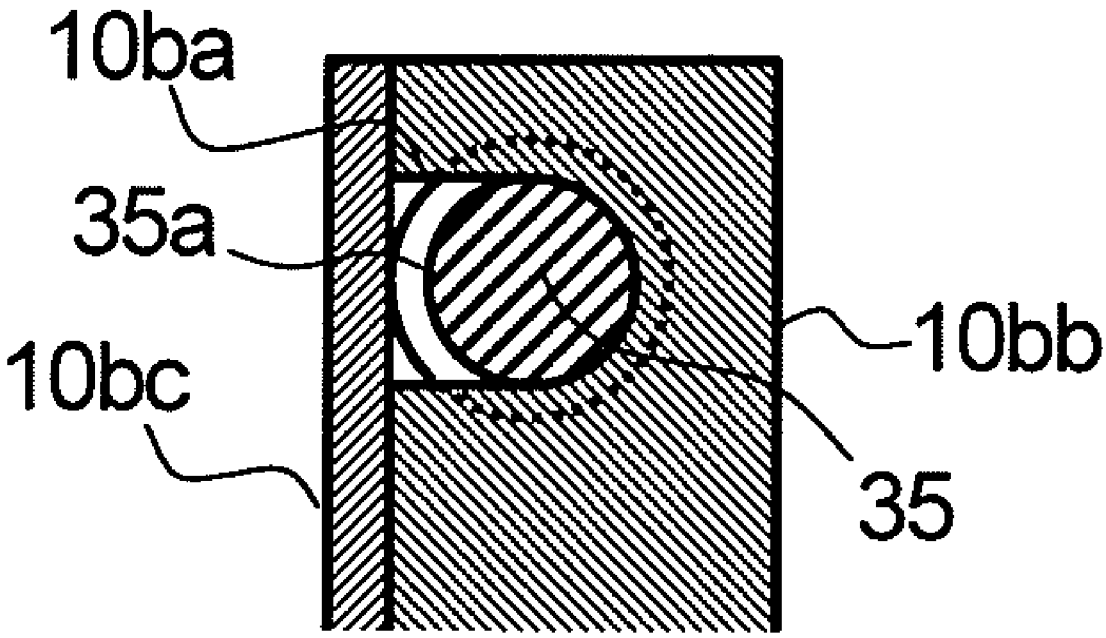
FIG. 5B is a sectional view along an A-A line in FIG. 5A.
Figure 5C:
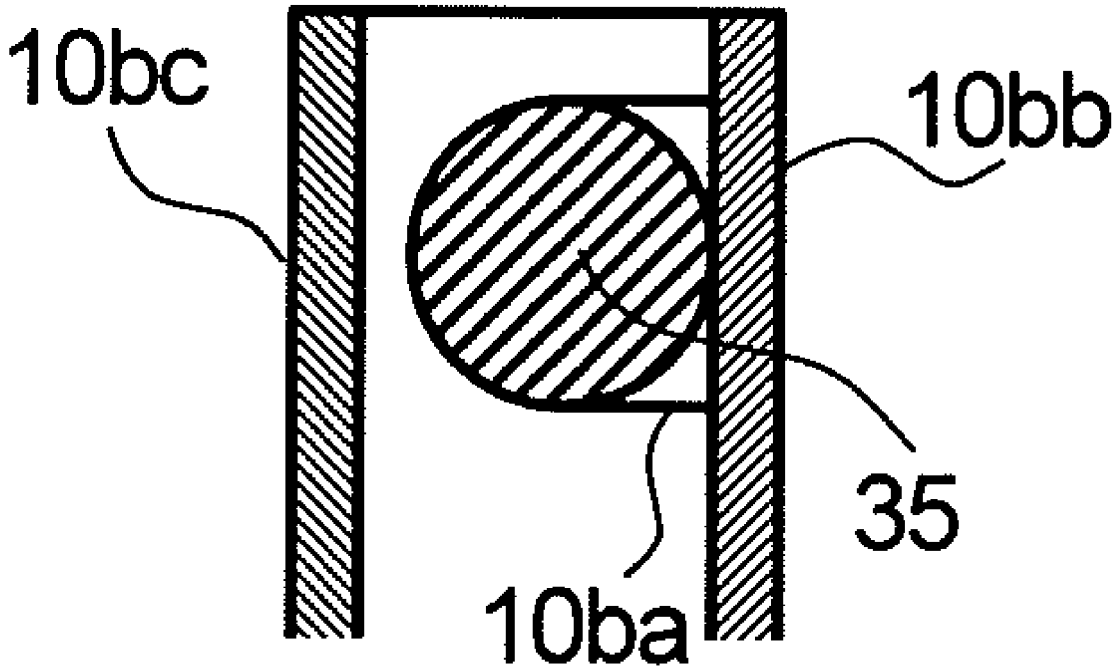
FIG. 5C is a sectional view along a B-B line in FIG. 5A.

As shown in FIG. 5A, the fourth engagement portion 33*a* (see FIG. 4) of the lift plate 33 is inserted onto the third shaft 35, and the second bearings 33*b* are inserted from both ends of the third shaft 35. And, a stopper 33*c* is mounted onto a groove that is formed between the third shaft 35 and the fourth engagement portion 33*a* at a more outside position than the second bearing 33*b*, so that the lift plate 33 is supported rotatably at a predetermined position in the shaft direction.

The manual supply tray 10*b* is inserted (see FIGS. 5A and 5B) in such a way that the second U-shape engagement portion 10*ba*, which is disposed on one side portion (left side in FIG. 5A) of the lower member 10*bb* and opens upward, fits in a positioning groove 35*a* disposed on the third shaft 35. The second engagement portion 10*ba* disposed on the other side portion (right side in FIG. 5A) has a dimension that fits in the outer diameter of the third shaft 35 (see FIG. 5C); when the upper member 10*bc* is engaged with the lower member 10*bb* with the second engagement portion 10*ba* fitted in the third shaft 35, the U-shape opening of the second engagement portion 10*ba* is closed by a rear surface of the upper member 10*bc*; and the manual supply tray 10*b* is rotatably supported at a predetermined position in the shaft direction by the third shaft 35 (see FIGS. 5B and 5C).

Next, an operation for mounting the third shaft 35, on which the lift plate 33 and the manual supply tray 10*b* are mounted, on a main body frame (frame body) 60 of the apparatus main body is described. The main frame body 60 is composed of a resin member of which many constituent components such as a rear-side wall 61, a front-side wall 62, a paper-sheet supply path and the like are unitarily formed.

To mount the third shaft 35 onto the main body frame 60, the rear-side wall 61 (left side in FIG. 5A) is provided with a first D-cut shape through-hole 61*a*, and the front-side wall 62 (right side in FIG. 5A) is provided with a second though-hole 62*a* that is larger than the outer diameter of the third shaft 35. Besides, the rear-side end portion of the third shaft 35 is formed into the same D-cut shape as the first through-hole 61*a*.

In mounting the third shaft 35 onto the main body frame 60, first, the front-side end portion of the third shaft 35 is inserted into the second through-hole 62*a* of the front-side wall 62, while the rear-side end portion is inserted into the first through-hole 61*a* of the rear-side wall 61. In this way, the third shaft 35 is set at a predetermined angle in the rotation angle, so that the rotation is limited. Then, a bearing fix member 63 is inserted onto the front-side end portion of the third shaft 35 and into the second through-hole 62*a* from outside (right side in FIG. 5A) of the front-side wall 62 of the main body frame 60, and the bearing fix member 63 is fixed to the front-side wall 62 by a fastening member 64, so that the third shaft 35 is fixed.

Here, the bearing fix member 63 is provided with a non-through-hole that has an inner diameter equal to the shaft diameter of the third shaft 35 and a boss portion that has an outer diameter equal to the inner diameter of the second through-hole 62*a*; the third shaft 35 is inserted into the non-through-hole of the bearing fix member 63, while the boss portion is inserted into the second through-hole 62*a*. In this way, the front-side end portion of the third shaft 35 is positioned and the position in the shaft direction of the third shaft 35 is limited.

Figure 5D:
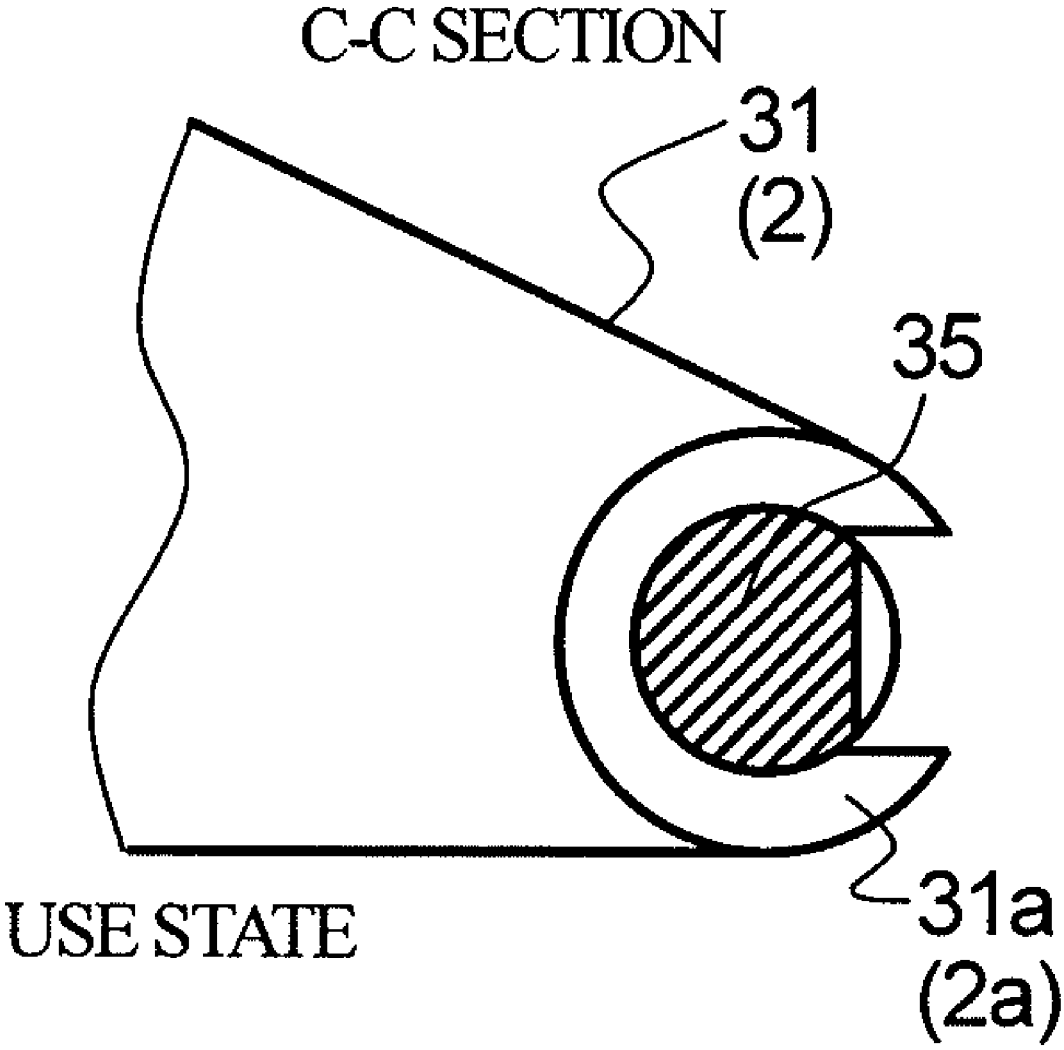
FIG. 5D is a sectional view along a C-C line in FIG. 5A and shows a use state.

The carry guide 31 and the left side cover 2 (see FIG. 3) are mounted with the third shaft 35 mounted on the main body frame 60. FIG. 5D shows an insertion portion of the third engagement portion 31*a* of the carry guide 31 that is inserted onto the third shaft 35. An area of the third shaft 35, which is more outside than the manual supply tray 10*b* and more inside than the position where the fourth engagement portion 33*a* of the lift plate 33 is inserted, is formed into a D-cut shape in section as shown in FIG. 5D as a C-C sectional view and the third shaft 35 is mounted in such a way that the cut surface faces downward in substantially a horizontal direction.

Figure 5E:
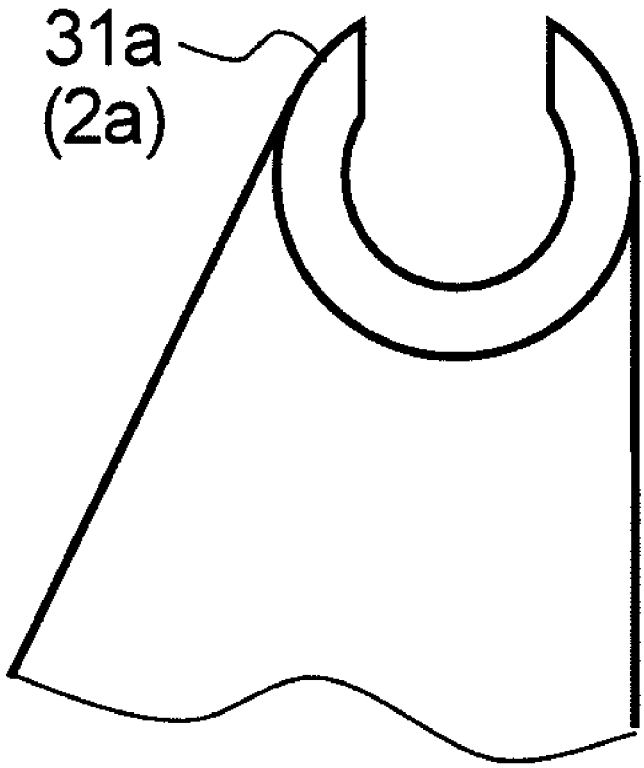
FIG. 5E is a view showing a state in which a carry guide (or a left side cover) is rotated to a mounting and demounting position from the state in FIG. 5D to be separated.

Besides, the third shaft 35 is cut into a D shape to become narrower than the width of the C-shape opening portion of the third engagement portion 31*a*. As shown in FIG. 5E, when the carry guide 31 is put into substantially a horizontal state, the C-shape opening portion of the third engagement portion 31*a* faces in substantially the horizontal direction to go into a state in which the carry guide 31 is insertable onto the third shaft 35 (mounting and demounting position). After the insertion of the third engagement portion 31*a*, when the carry guide 31 is rotated upward as shown in FIG. 5D, the C-shape opening portion deviates form the D-cut surface direction, which is a state in which the carry guide 31 does not come off the third shaft 35 (use state). Besides, like the carry guide 31, the first engagement portion 2*a* of the left side cover 2 also is mounted onto the third shaft 35 (see FIGS. 5D and 5E).

Further, the left side cover 2 is connected to the main body frame 60 by a not-shown hinge member (limit member) and set into a state in which the left side cover 2 does not open wider than a defined angle by the hinge member. In this way, the carry guide 31 also is limited not to open wider than the defined angle by the left side cover 2. The defined angle is set at an angle smaller than 90° and the left side cover 2 and the carry guide 31 are limited not to open wider than a horizontal angle (see FIG. 5E) where the first engagement portion 2*a* of the left side cover 2 and the third engagement portion 31*a* of the carry guide 31 become mountable and demountable.

In this way, even when the left side cover 2 and the carry guide 31 rotate in the area (first area) limited by the hinge member, the first engagement portion 2*a* and the third engagement portion 31*a* are not able to be mounted and demounted on and from the third shaft 35 (see FIG. 5D); when the limitation by the hinge member is released, the left side cover 2 and the carry guide 31 are able to exceed the first area to rotate to an area (second area) where the left side cover 2 and the carry guide 31 are able to be mounted and demounted (see FIG. 5E). Accordingly, an efficient assembly operation is achieved and the maintenance operation becomes easy.

Figure 6:
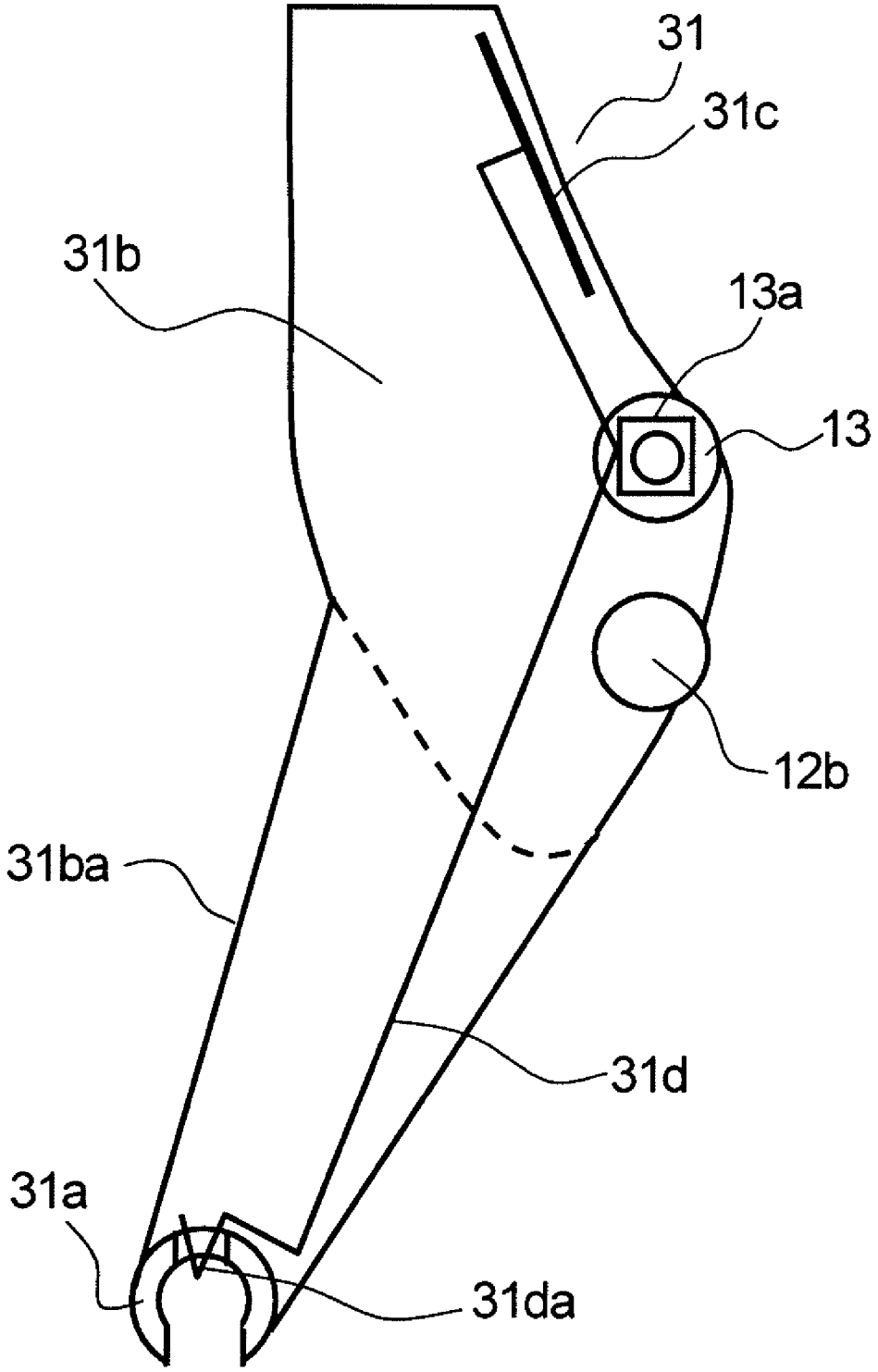
FIG. 6 is a view showing a schematic structure of a unit single body of a carry guide.

Next, the ground member (ground member) 31*d* that is disposed on the carry guide 31 is described with reference to FIG. 6. FIG. 6 is a view showing a schematic structure of a unit single body of the carry guide 31. In the carry guide 31, the driven roller 12*b* of the pair of resist rollers 12 and the transfer roller 13 are rotatably disposed on a carry guide frame 31*b* that is formed of a resin material, and the metal guide member 31*c* is mounted. The leg portions 31*ba* extend downward from front and rear end portions (direction perpendicular to the paper surface of FIG. 6) of the carry guide frame 31*b*; and at their end portions, as described above, the third engagement portions 31*a* that are inserted onto the third shaft 35 to support the carry guide 31 is formed.

The ground member 31*d* is able to be formed of a line material or a thin plate that have electrical conductivity and are able to be elastically deformed. The ground member 31*d* is bent into substantially a dogleg shape and mounted in such a way that at one side surface in the front-to-rear direction of the carry guide frame 31*b*, a central portion of the dogleg shape comes into contact with an electrically conductive bearing 13*a* that is an electrically conductive member which rotatably supports the transfer roller 13; and an upper-side end portion comes into contact with a shaft-direction end portion of the guide member 31*c*. On the other hand, a lower-end side of the ground member 31*d* penetrates the inside of the leg portion 31*ba* and a lower-side end portion 31*da* is formed to protrude from the inner-wall portion of the third engagement portion 31*a*. Besides, the lower-side end portion 31*da* is bent to be able to be elastically deformed.

And, when the carry guide 31 is supported by inserting the third engagement portion 31*a* onto the third shaft 35, the lower-side end portion 31*da* of the ground member 31*d* butts against the circumferential surface of the third shaft 35 to be elastically deformed. On the other hand, the third shaft 35 is structured in such a way that the tip end which protrudes from the rear-side wall 61 (see FIG. 5A) of the main body frame 60 comes into contact with a ground terminal (not shown). In this way, in the use state (see FIG. 5D), the transfer roller 13 and the guide member 31*c* are ground-connected. As described above, because the ground member 31*d* is able to electrically ground the transfer roller 13 and the guide member 31*c* that are disposed on the carry guide 31 via the third shaft 35, it is not necessary to separately dispose a complicated ground member and it is possible to achieve a reduction in the number of parts and an efficient assembly operation.

Figure 7A:
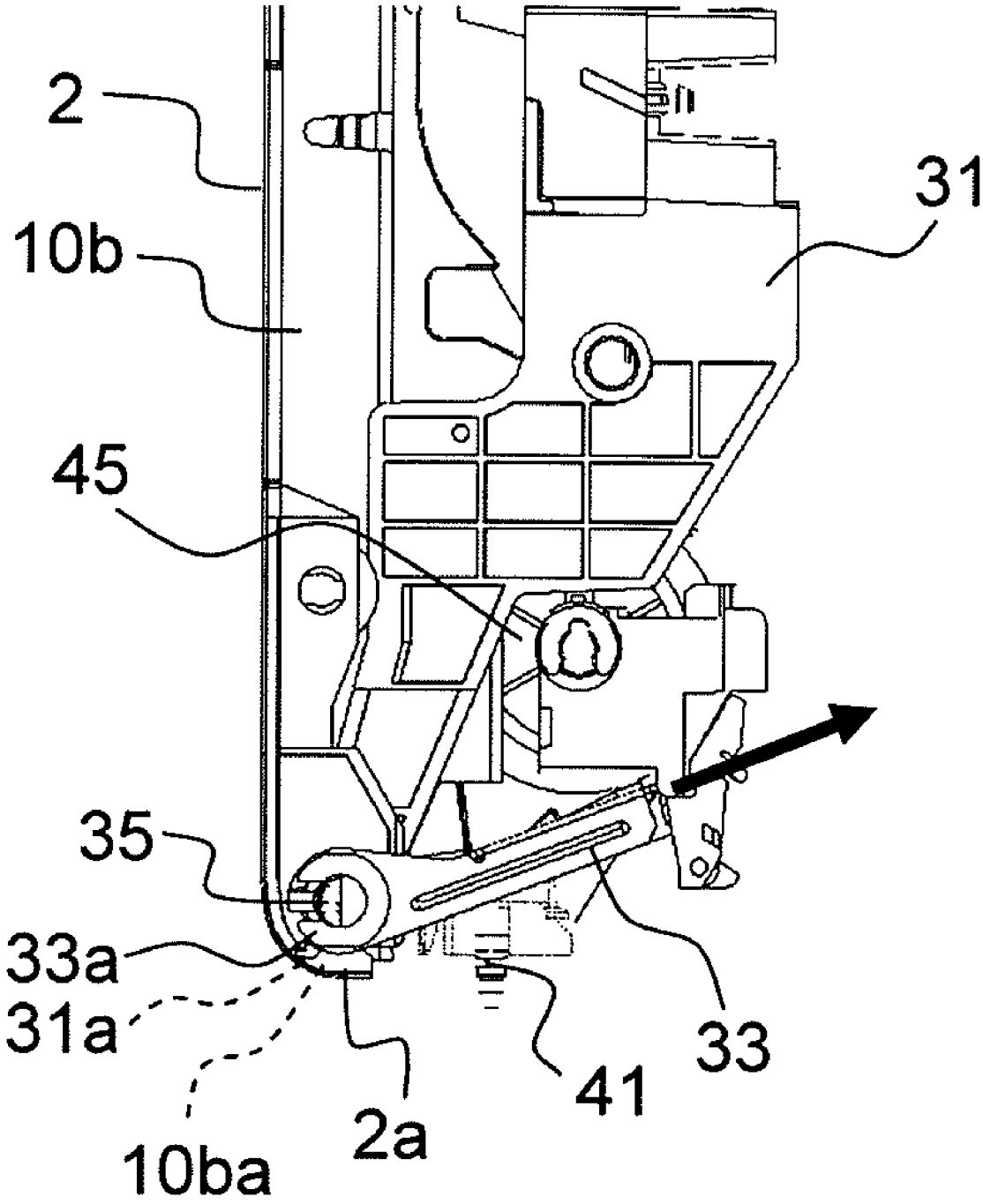
FIG. 7A is a side view showing a disposition state of a lift plate seen from a B direction in FIG. 4 when a paper sheet is pressurized against a paper-sheet supply roller, and a view in a time a small number of paper sheets are placed on a manual supply tray.
Figure 7B:
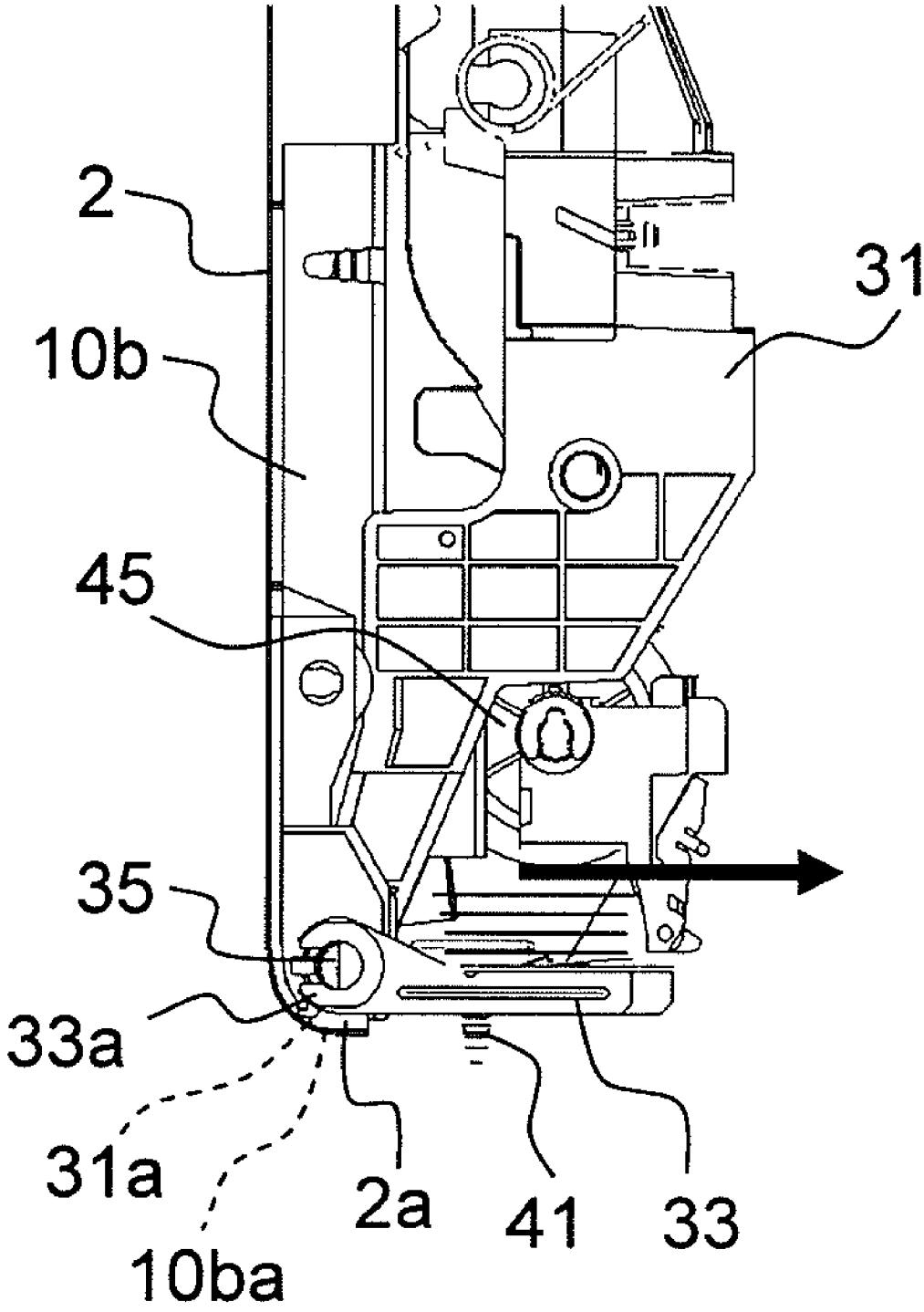
FIG. 7B is a side view showing a disposition state of a lift plate seen from a B direction in FIG. 4 when a paper sheet is pressurized against a paper-sheet supply roller, and a view in a time a large number of paper sheets are placed on a manual supply tray.
Figure 8:
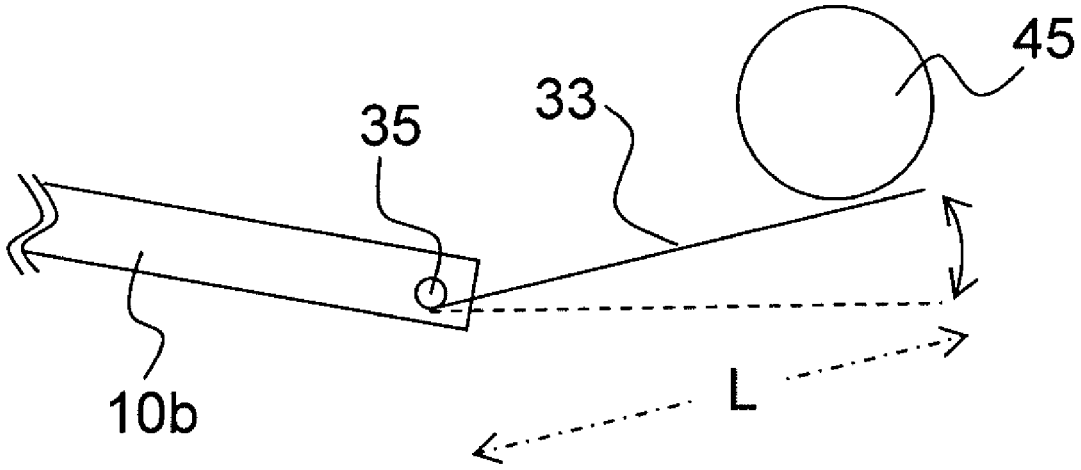
FIG. 8 is a view showing an inclination state of a lift plate.
Figure 9A:
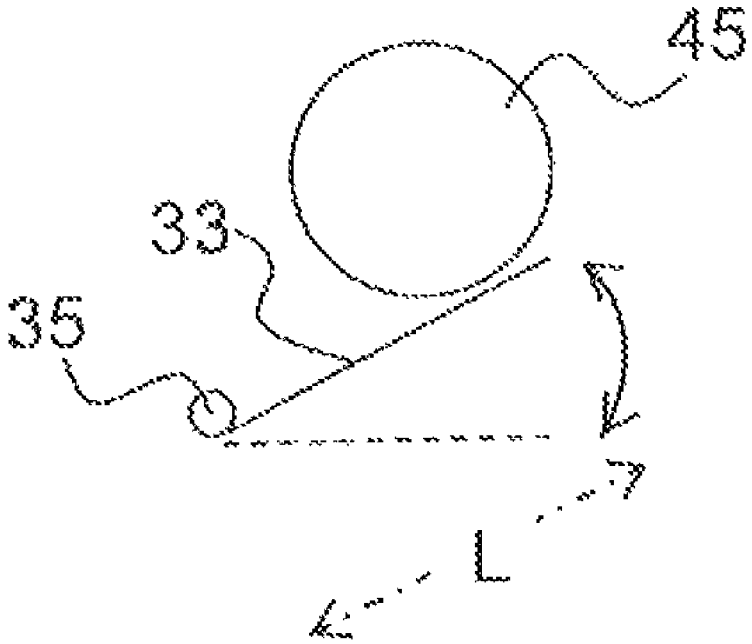
Fig. 9 A CONVENTIONAL ART
FIG. 9A is a view showing an inclination state of a lift plate in a conventional example.
Figure 9B:
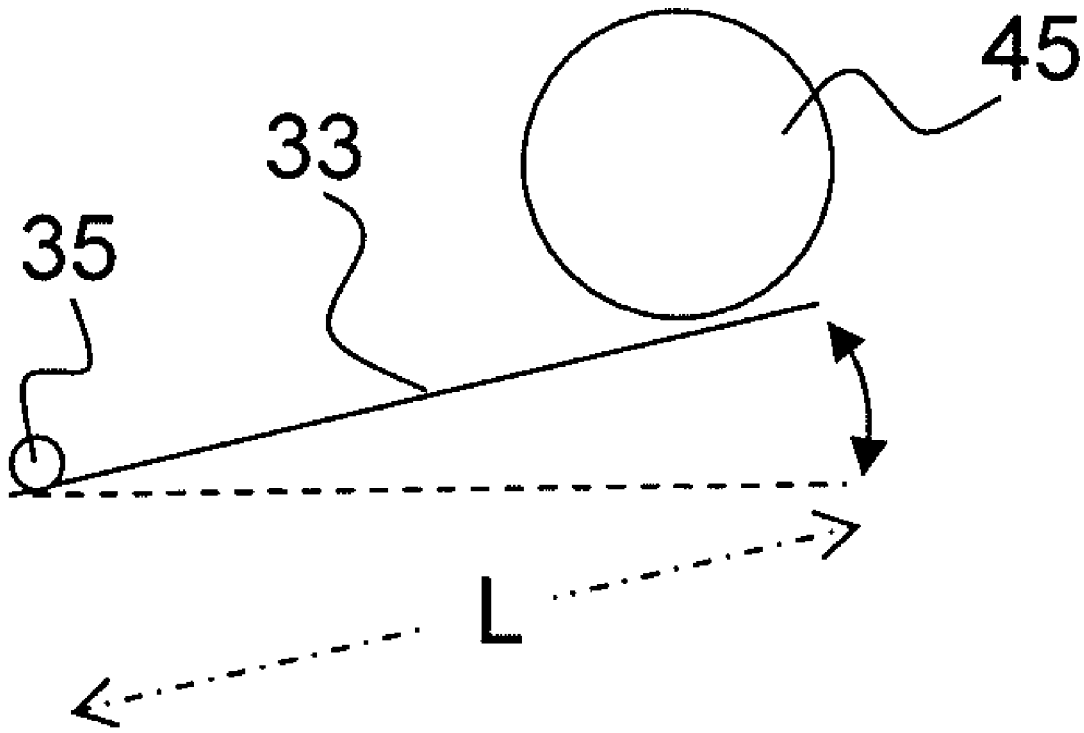
FIG. 9B is a view showing an inclination state of a lift plate in the present embodiment.

FIG. 7 is a side view showing a disposition state of the lift plate seen from a B direction in FIG. 4 when a paper sheet is pressurized against a paper-sheet supply roller, of which FIG. 7A is a view when a small number of paper sheets are placed on the paper-sheet supply tray; and FIG. 7B is a view when a large number of paper sheets are placed on the paper-sheet supply tray; FIG. 8 is a view showing an inclination state of the lift plate; FIG. 9 is a view that shows an inclination state in comparison with a conventional inclination state of which FIG. 9A is a view showing an inclination state in a conventional example; and FIG. 9B is a view showing an inclination state in the present embodiment. Here, in FIGS. 7 to 9, the views seen from the front side of the apparatus main body are shown.

As shown in FIG. 7, the lower surface of the lift plate 33 is energized upward by the coil spring 41, and as shown in FIG. 3, the upper surface of the lift plate 33 comes into contact with an outer circumferential surface of an eccentric cam 43 that is rotated by a drive motor (not shown).

When the lift plate 33 counters the energizing force of the coil spring 41 to rotate as the eccentric cam 43 rotates, the paper sheets placed on the manual supply tray 10*b* are separated from the paper-sheet supply roller 45 and arranged in the carry direction from the paper-sheet supply tray 10*b*; when the eccentric cam 43 further rotates, the uppermost surface of the paper sheets placed on the manual supply tray 10*b* is able to be pressurized against the paper-sheet supply roller 45 by the energizing force of the coil spring 41. The separation and pressurization operation is repeated, so that the paper sheets are able to be supplied from the manual supply tray 10*b* to the carry guide 31 one after another by the paper-sheet supply roller 45.

As shown in FIG. 7A, when a small number of paper sheets are placed on the lift plate 33, the lift plate 33 rotates upward to make the paper sheet butt against the paper-sheet supply roller 45 in an inclined state. In this way, the paper sheet is carried in an oblique direction by the paper-sheet supply roller 45. In contrast, as shown in FIG. 7B, when a large number of paper sheets are placed on the lift plate 33, the lift plate 33 rotates more downward than the position shown in FIG. 7A to make the paper sheet butt against the paper-sheet roller 45 substantially horizontally. In this way, the paper sheet is carried substantially horizontally by the paper-sheet supply roller 45.

As described above, the inclination angle of the lift plate 33 changes depending on the number of paper sheets placed on the manual supply tray 10*b* and the paper-sheet carry angle also changes with the inclination angle. In the present embodiment, because the fourth engagement portion 33*a* is fitted onto the third shaft 35 together with the first and second engagement portions 2*a* and 10*ba* of the left side cover 2 and the manual supply tray 10*b*, it is possible to lengthen the protrusion length L of the lift plate 33 as shown in FIG. 8. In other words, it is possible to make the protrusion length L in the present embodiment shown in FIG. 9B larger than the conventional example shown in FIGS. 9A, 18 and 19 described above.

In this way, even in a case where a small number of paper sheets are placed on the manual supply tray 10*b*, it is possible to make the inclination angle of the lift plate 33 smaller than the conventional example and reduce a difference between the inclination angle in the case where the number of paper sheets is small and the inclination angle in the case where the number of paper sheets is large. Accordingly, it is possible to decrease the number of parts and achieve the size reduction by supporting the manual supply tray 10*b* and the left side cover 2 on the same third shaft 35, and also reduce the change in the carry state caused by the number of paper sheets and stabilize the paper-sheet carry characteristic.

Especially, in the present embodiment, because the third engagement portion 31*a* of the carry guide 31 is supported by the third shaft 35 together with the first, second and fourth engagement portions 2*a*, 10*ba* and 33*a*, it is possible to further achieve the size reduction of the apparatus main body. However, it is also possible to support the third engagement portion 31*a* of the carry guide 31 on a shaft that is separately disposed in the apparatus main body.

Besides, here, the third shaft 35 is supported on the main body frame 60 by using the bearing fix member 63; however, it is possible to support the third shaft 35 on the main body frame 60 by using another bearing member.

Figure 10:
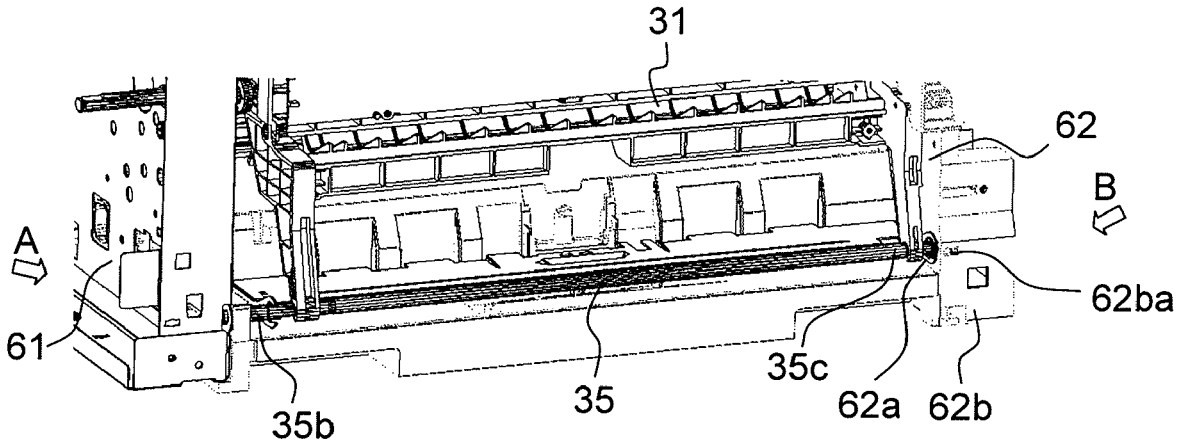
FIG. 10 is a perspective view showing a bearing that is used in an image forming apparatus according to a second embodiment of the present invention.
Figure 11A:
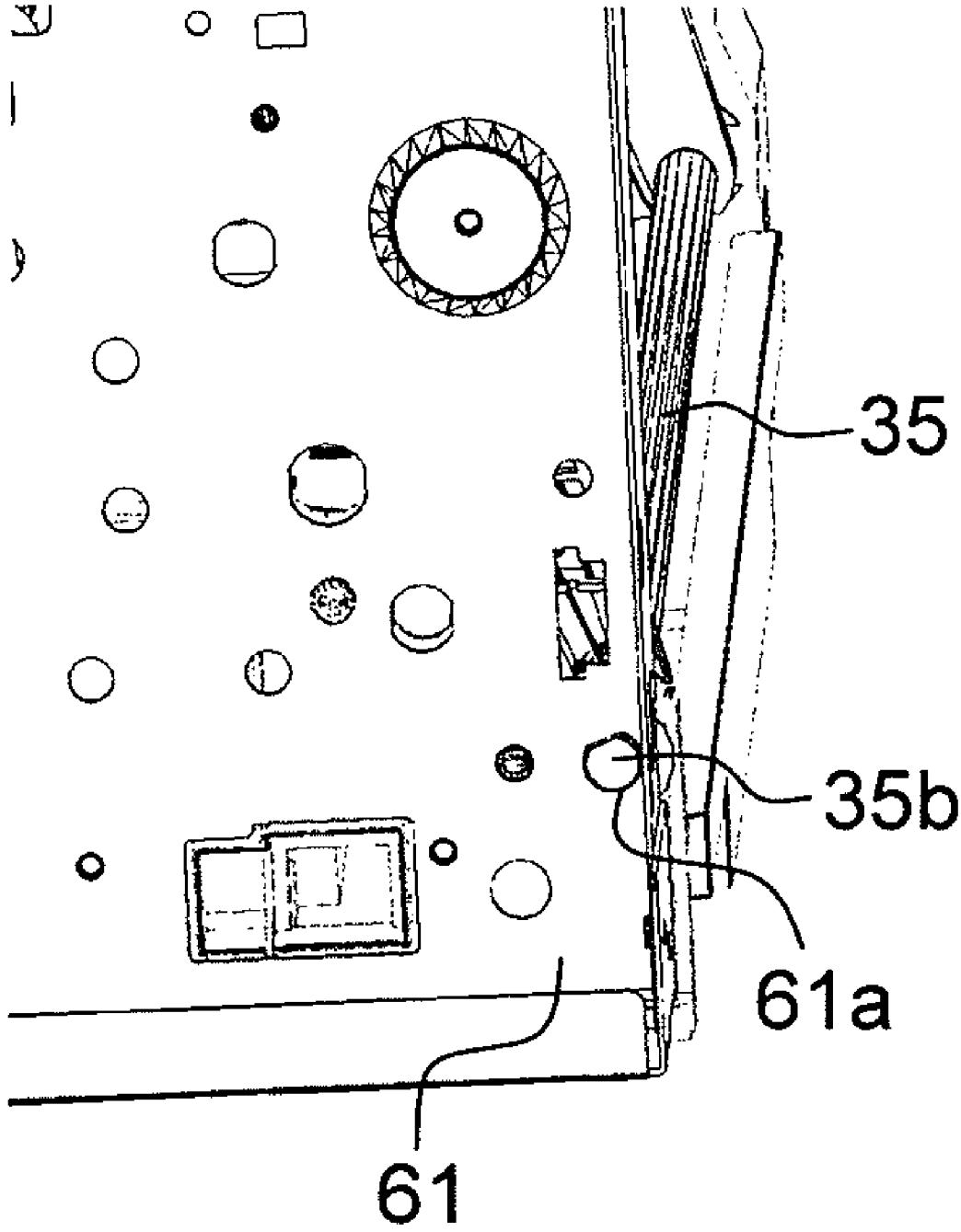
FIG. 11A is a perspective view showing FIG. 10 from an A direction (rear side).
Figure 11B:
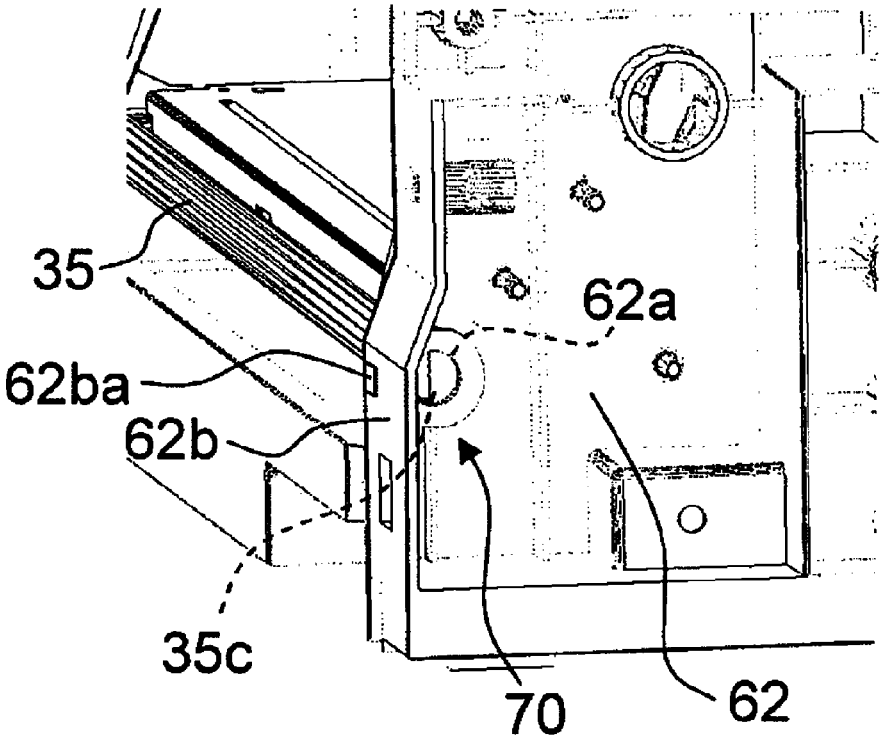
FIG. 11B is a perspective view showing FIG. 10 from a B direction (front side).

Next, an image forming apparatus according a second embodiment of the present invention is described. FIG. 10 is a perspective view showing a bearing that is used in the image forming apparatus according to the second embodiment of the present invention; FIG. 11A is a perspective view showing FIG. 10 from an A direction (rear side); and FIG. 11B is a perspective view showing FIG. 10 from a B direction (front side). Portions common to FIGS. 1 to 9 and FIG. 17 are indicated by common reference numbers and description of them is skipped. Besides, because the second embodiment is the same as the above embodiment except the technology for supporting the third shaft 35 on the apparatus main body, description of the same functions is skipped.

As shown in FIG. 10, the above carry guide 31 is rotatably supported by the third shaft 35. Besides, as shown in FIG. 11A, a rear-side end portion 35*b* of the third shaft 35 is formed into a D shape in section and inserted into the first through-hole 61*a* formed through the rear-side wall 61 of the apparatus main body and fixed. On the other hand, as shown in FIG. 11B, a front-side end portion 35*c* is penetrates the second through-hole 62*a* formed through the front-side wall 62 and fixed by the first bearing (bearing member) 70.

Figure 12:
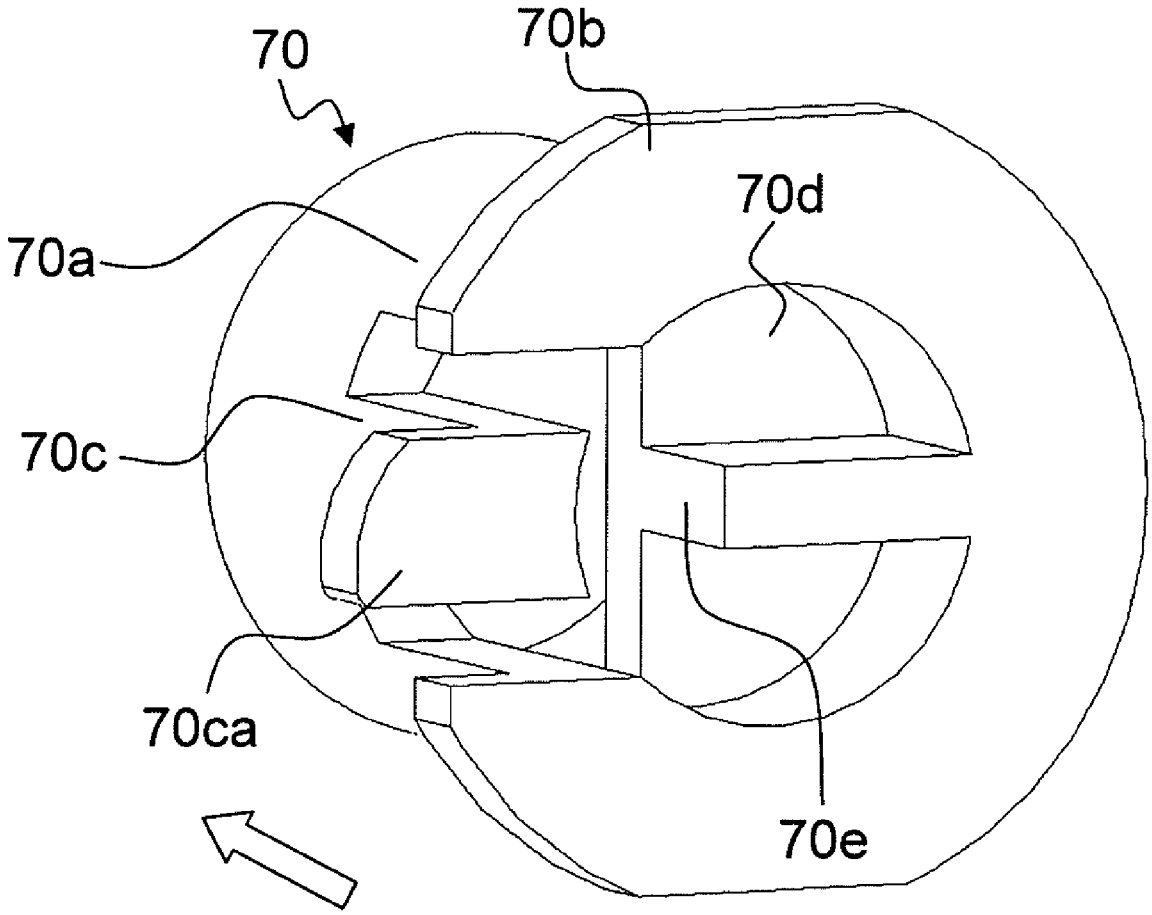
FIG. 12 is a perspective view showing the bearing in the present embodiment.
Figure 13:
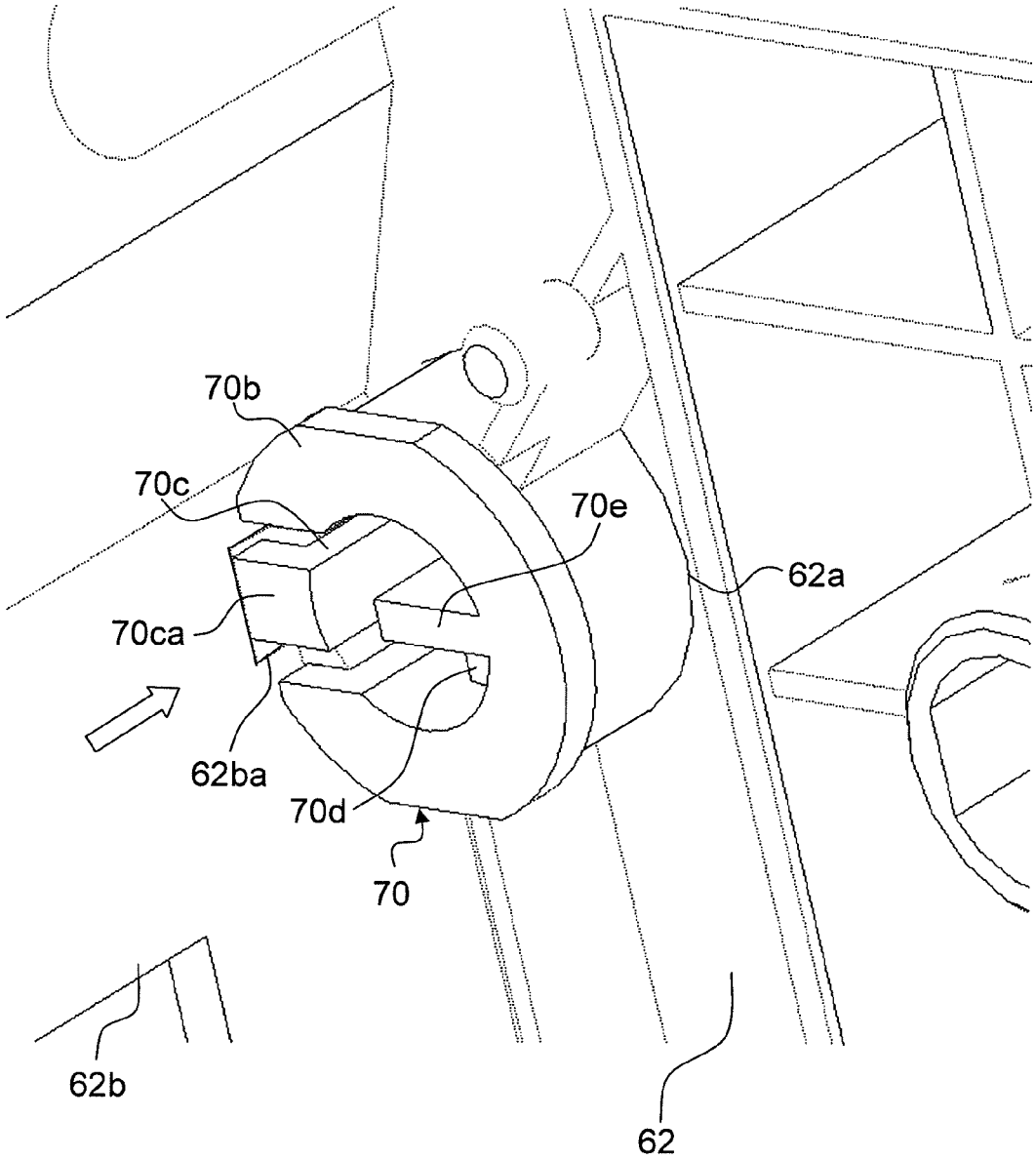
FIG. 13 is a perspective view showing a state in which the bearing in the present embodiment is mounted on an apparatus main body.

FIG. 12 is a perspective view showing the bearing in the present embodiment; and FIG. 13 is a perspective view showing a state in which the bearing in the present embodiment is mounted on the apparatus main body. The first bearing 70 is composed of: a main body portion 70*a*; a flange portion 70*b*; an engagement pawl portion 70*c*; a butt portion 70*d*; and a limit portion 70*e*. The main body portion 70*a* is formed into a cylindrical shape and fitted into the second through-hole 62*a* of the front-side wall 62 of the apparatus main body in an arrow direction shown in the figure.

The flange portion 70*b* that protrudes substantially vertically is formed at a separation-side (direction opposite to the outline arrow) end portion of the outer circumferential surface of the main body portion 70*a*. The flange portion 70*b* puts a limit to movement of the first bearing 70 toward a more mounting-side (the outline-arrow direction) position than the second through-hole 62*a*. And, two cutouts are formed substantially horizontally at positions a predetermined distance away from each other, toward a central portion from the flange portion 70*b* along a longitudinal direction of the main boy portion 70*a*, so that the engagement pawl portion 70*c* is formed. A protrusion end portion 70*ca* of the engagement pawl portion 70*c* constitutes part of the flange portion 70*b*.

Besides, the engagement pawl portion 70*c*, as shown in FIG. 14 described later, is able to bend toward the inner circumferential side of the main body portion 70*a*. Because of this, by hooking and fitting (engaging) the protrusion end portion 70*ca* of the engagement pawl portion 70*c* on and into the engagement hole (engagement portion) 62*ba* formed through the front-side frame portion 62*b* of the front-side wall 62, it is possible to mount the first bearing 70 on the apparatus main body. Besides, by bending the engagement pawl portion 70*c* toward the inside, it is possible to separate (disengage) the protrusion end portion 70*ca* from the engagement hole 62*ba*.

Besides, the outer diameter of the protrusion end portion 70*ca* is formed to become larger from one circumferential-direction end portion (here, an upside end portion in FIG. 12) to the other circumferential-direction end portion (here, a downside end portion in FIG. 12). Because of this, as shown in FIG. 15, it is possible to release the engagement between the protrusion end portion 70*ca* and the engagement portion 62*ba* by one-direction (clockwise) rotation only.

The butt portion 70*d* formed of a plate member that is substantially parallel to the flange portion 70*b* is formed on the inner circumferential surface of the main body portion 70*a*. The butt portion 70*d* is formed into such a C shape that is formed by cutting out part of a circle. Besides, the butt portion 70*d* is formed away from the engagement pawl portion 70*c* by a predetermined distance, so that the engagement pawl portion 70*c* is able to sufficiently bend toward the inner circumferential side. Besides, when the first bearing 70 is mounted on the apparatus main body as shown in FIG. 13, the butt portion 70*d* butts against the front-side end portion 35*c* of the third shaft 35, thereby preventing the third shaft 35 from falling off the apparatus main body.

The limit portion 70*e* is formed at a position that is opposite to the engagement pawl portion 70*c* and away from the engagement pawl portion 70*c* by a predetermined distance on the inner circumferential surface of the main body portion 70*a*. The limit portion 70*e* not only protrudes substantially perpendicularly from the inner circumferential surface of the main body portion 70*a* but also protrudes substantially perpendicularly from the butt portion 70*d*, and is formed into substantially a convex shape when seen from the engagement pawl portion 70*c* side. When separating the first bearing 70 from the apparatus main body, the movement of the engagement pawl portion 70*c* toward the inner circumferential side is limited by the limit portion 70*e*, so that the engagement pawl portion 70*c* is prevented from excessively bending toward the inside. In this way, it is possible to prevent breakdown of the engagement pawl portion 70*c*.

Figure 14A:
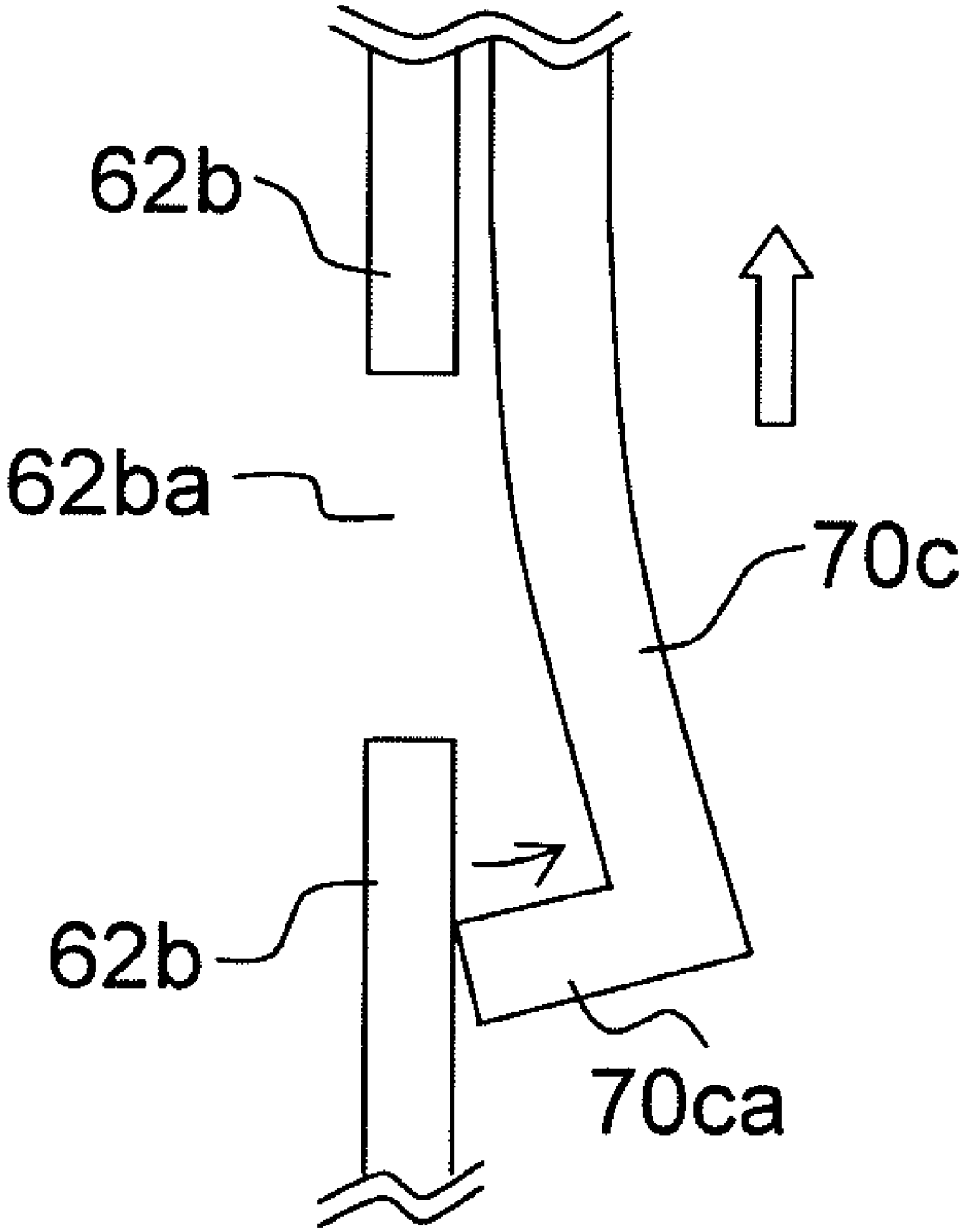
FIG. 14A is a partial side view showing a state of an engagement pawl portion before the bearing in the present embodiment is mounted.
Figure 14B:
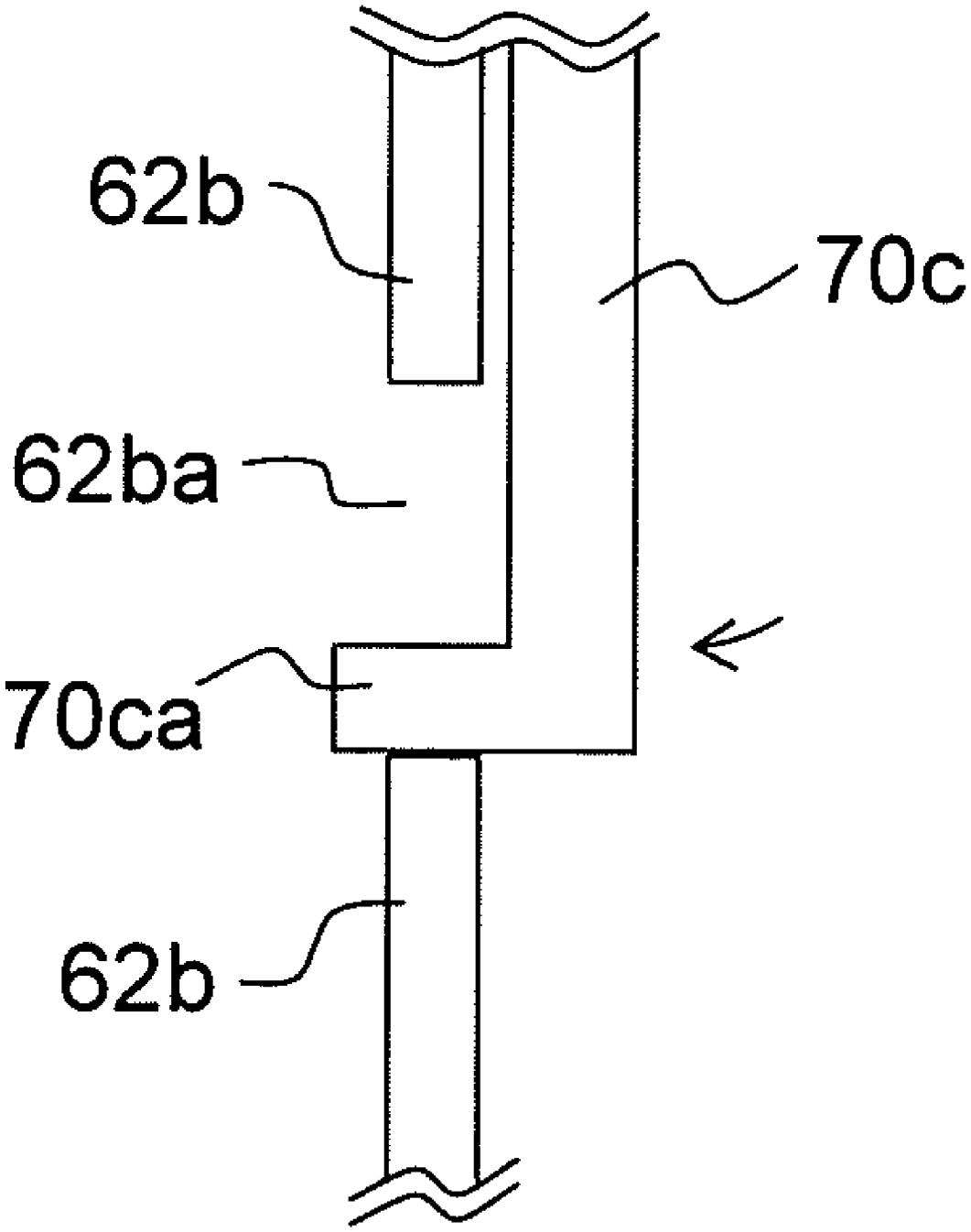
FIG. 14B a partial side view showing a state of the engagement pawl portion after the bearing in the present embodiment is mounted.
Figure 15A:
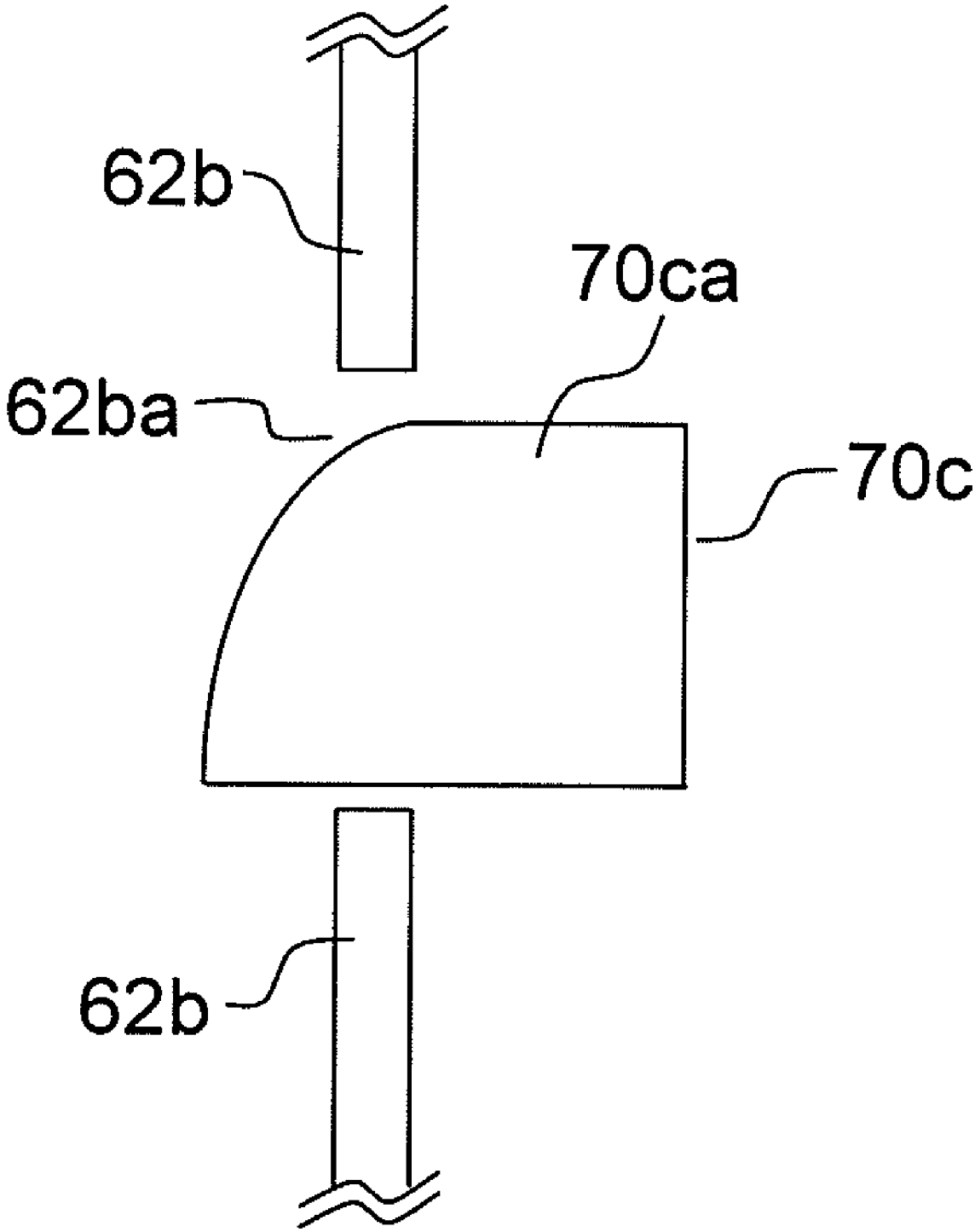
FIG. 15A is a front view showing a state of a protrusion end portion of the engagement pawl portion when the bearing in the present embodiment is mounted on the apparatus main body.
Figure 15B:
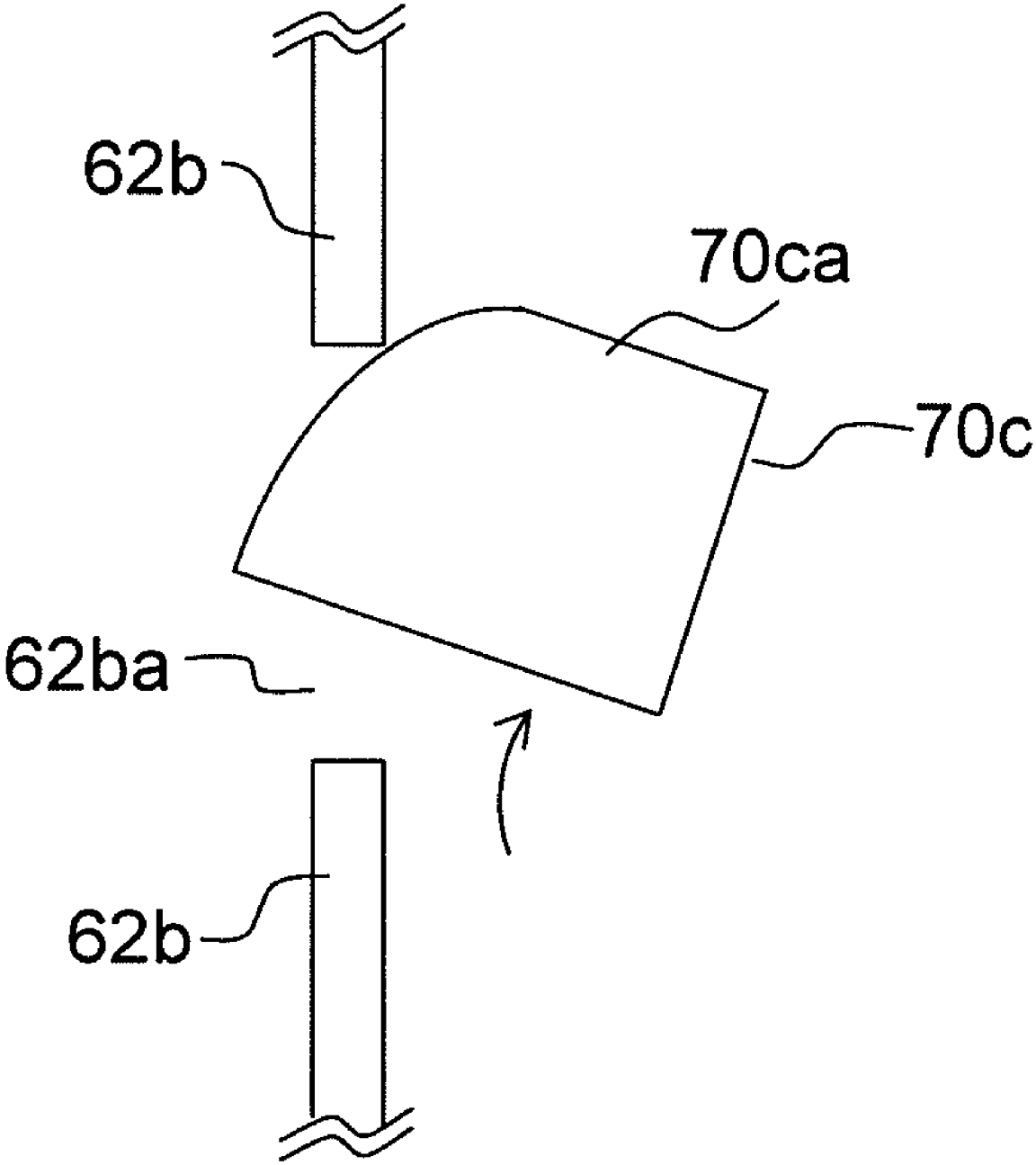
FIG. 15B is a front view showing a state of the protrusion end portion of the engagement pawl portion when the bearing in the present embodiment is separated from the apparatus main body.

Next, operation for mounting and demounting the first bearing 70 on and from the apparatus main body is described. FIG. 14A is a partial side view showing a state of the engagement pawl portion before the bearing in the present embodiment is mounted; and FIG. 14B is a partial side view showing a state of the engagement pawl portion after the bearing in the present embodiment is mounted. Besides, FIG. 15A is a front view showing a state of the protrusion end portion of the engagement pawl portion when the bearing in the present embodiment is mounted on the apparatus main body; and FIG. 15B is a front view showing a state of the protrusion end portion of the engagement pawl portion when the bearing in the present embodiment is separated from the apparatus main body.

First, the mounting of the first bearing 70 is described. As described above, the third shaft 35 is inserted into the second through-hole 62*a*, and the rear-side end portion 35*b* of the third shaft 35 is inserted into the first through-hole 61*a* of the rear-side wall 61 (see FIG. 11A). Then, the first bearing 70 is inserted onto the front-side end portion 35*c* of the third shaft 35, and the main body portion 70*a* is inserted into the second through-hole 62*a* of the front-side wall 62 with the engagement pawl portion 70*ca* of the first bearing 70 being moved on the front-side frame portion 62*b* of the front-side wall 62. Here, as shown in FIG. 14A, because the engagement pawl portion 70*c* of the first bearing 70 is pushed back by reaction from the front-side frame portion 62*b*, the engagement pawl portion 70*c* bends toward the inner circumferential side (solid-line arrow direction).

As described above, the engagement pawl portion 70*c* bends and the first bearing 70 moves toward the apparatus side (outline arrow direction). And, when the protrusion end portion 70*ca* of the engagement pawl portion 70*c* is fitted into the engagement hole 62*ba* of the front-side frame portion 62*b*, the engagement pawl portion 70*c* returns to its original shape with no flexure and, as shown in FIG. 14B, the protrusion end portion 70*ca* hooks on the engagement hole 62*ba*. In this way, the first bearing 70 is mounted into the second through-hole 62*a* and prevented from falling off the apparatus main body. Here, an end surface of the front-side end portion 35*c* of the third shaft 35 is in contact with the butt portion 70*d* of the first bearing 70, so that the third shaft 35 is prevented from falling off the main body portion 70*a*.

Next, the demounting of the first bearing 70 is described. By bending the engagement pawl portion 70*c* toward the inner circumferential side (see FIG. 14A) from the mounted state shown in FIG. 14B, it is possible to release the engagement between the protrusion end portion 70*ca* and the engagement hole 62*ba*. Here, because the outer diameter of the protrusion end portion 70*ca* is formed to become larger from the upper end portion to the lower end portion, as shown in FIG. 15B, by rotating clockwise (solid-line arrow direction) the first bearing 70 from the mounted state shown in FIG. 15A, it is possible to bend the engagement pawl portion 70*c* and disengage the engagement end portion 70*ca* from the engagement hole 62*ba* to release the engagement.

As described above, the main body portion 70*a*, the flange portion 70*b*, the engagement pawl portion 70*c* and the butt portion 70*d* are formed on the first bearing 70; the engagement pawl portion 70*c* bends toward the inner circumferential side of the main body portion 70*a* in times of the mounting and demounting of the first bearing 70 onto the apparatus main body, so that the protrusion end portion 70*ca* of the engagement pawl portion 70*c* engages with and disengages from the engagement portion 62*ba*. Accordingly, it becomes possible to easily mount and demount the first bearing 70 on and from the apparatus main body even in a place where it is hard to work without using additional members and tools. Besides, the cost is reduced and resource conservation is achieved.

Besides, in the present embodiment, because the limit portion 70*e* for putting a limit to flexure of the engagement pawl portion 70*c* toward the inner circumferential side is formed on the inner circumferential surface of the main body portion 70*a*, it is possible to prevent the engagement pawl portion 70*c* from excessively bending to break down when mounting and demounting the first bearing 70. Here, because the limit portion 70*e* protrudes from the inner circumferential surface of the main body portion 70*a* and from the butt portion 70*d*, it is possible to increase the anti-pressure strength of the limit portion 70*e*.

Besides, in the present embodiment, because the outer diameter of the protrusion end portion 70*ca* is formed to become larger from the upside end portion to the downside end portion, it is possible to disengage the engagement pawl portion 70*c* from the engagement portion 62*ba* by only rotating clockwise the first bearing 70 (see FIG. 15), so that the workability improves.

However, the outer diameter of the protrusion end portion 70*ca* is not especially limited to the above embodiment and is able to be suitably set according to the structure and the like of the apparatus main body. For example, contrary to the above embodiment, the outer diameter of the protrusion end portion 70*ca* is formed to become larger from the downside end portion to the upside end portion in FIG. 15, so that it is also possible to separate the engagement pawl portion 70*c* from the engagement hole 62*ba* by rotating the first bearing 70 counterclockwise.

Figure 16:
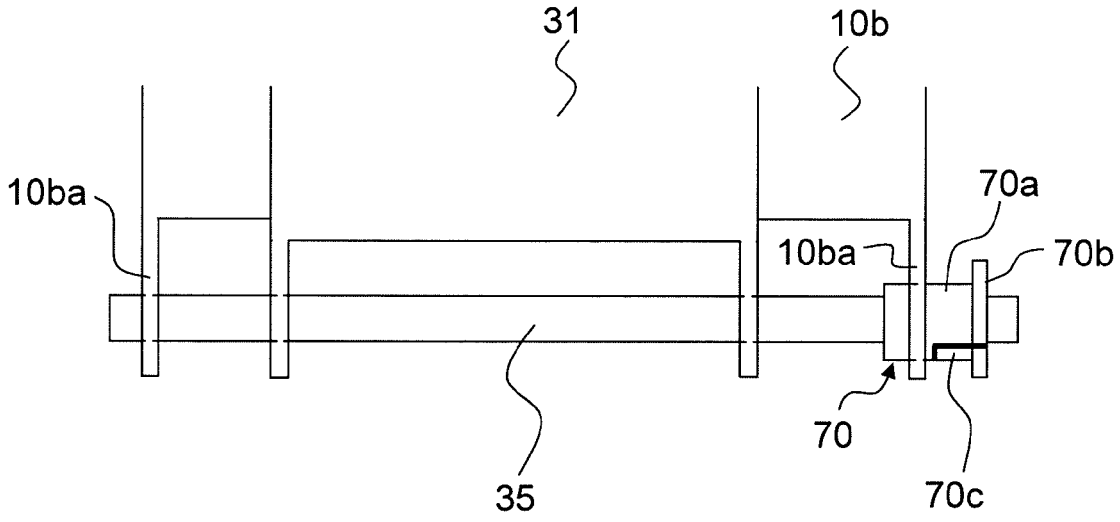
FIG. 16 is a side view showing a support shaft on which a bearing used in an image forming apparatus according to a third embodiment of the present invention is mounted and components around the support shaft.
Figure 17:
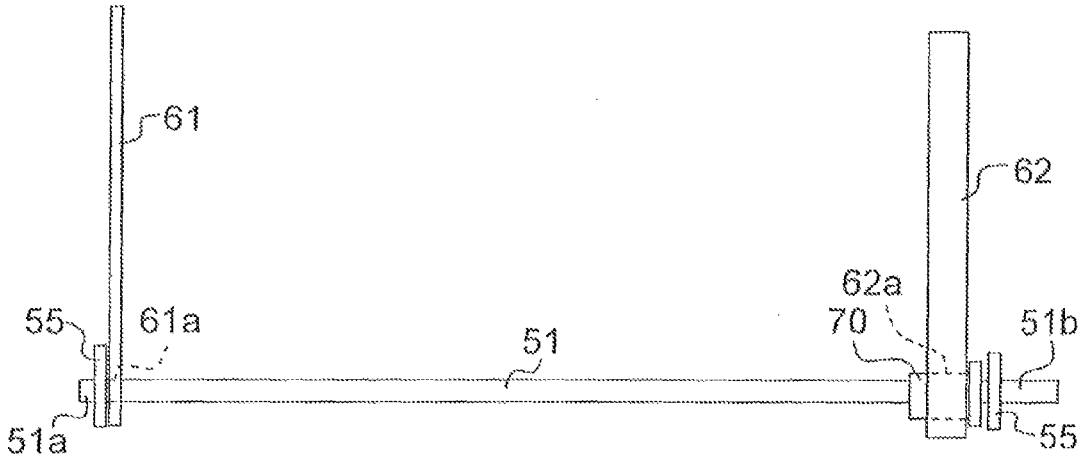
Fig. 17 CONVENTIONAL ART
FIG. 17 is a side view showing a support shaft on which a conventional bearing is supported and components around the support shaft.

Next, an image forming apparatus according to a third embodiment of the present invention is described. FIG. 16 is a side view showing a support shaft on which a bearing used in the image forming apparatus according to the third embodiment of the present invention is mounted and components around the support shaft. Portions common to FIGS. 1 to 15 are indicated by common reference numbers and description of them is skipped. Besides, in FIG. 16, the side cover 2 and the lift plate 33 are not shown.

As shown in FIG. 16, in the present embodiment, of the second engagement portion 10*ba* on the rear side (left side in the figure) with respect to the shaft direction of the manual supply tray 10*b* and the second engagement portion 10*ba* on the front side (right side in the figure) with respect to the shaft direction of the manual supply tray 10*b*, the second engagement portion 10*ba* on the rear side is rotatably supported by the third shaft 35.

On the other hand, the second engagement portion 10*ba* on the front side is rotatably supported by the main body portion 70*a* of the first bearing 70. Because the other structures are the same as those in the second embodiment, description of them is skipped. According to the present embodiment, because it is possible to share the support third shaft 35 for supporting the manual supply tray 10*b* with the carry guide 31, it is possible to further reduce the number of members. Besides, because it is not necessary to separately dispose a bearing member and the like for supporting the manual supply tray 10*b*, it is possible to further reduce the number of members.

Here, the second engagement portion 10*ba* on the front side of the manual supply tray 10*b* is supported by the first bearing 70; however, it is possible to mount the first bearing 70 onto the rear-side end portion 35*b* of the third shaft 35 and support the front-side and rear-side second engagement portions 10*ba* by the two first bearings 70. Besides, it is possible to support the first engagement portion 2*a* of the side cover 2 and the third engagement portion 31*a* of the carry guide 31, or the fourth engagement portion 33*a* of the lift plate 33 on the first bearing 70.

In addition, the present invention is not limited to the above embodiment and various modifications are possible without departing from the spirit of the present invention. For example, in the above embodiment, the left side cover 2, and the manual supply tray 10*b*, the carry guide 31 and the lift plate 33 that are arranged in the vicinity of the inner surface of the left side cover 2 are supported by the same third shaft 35; however, it is possible to support the right side cover, the front cover, the rear cover, and the manual supply tray 10*b*, the carry guide 31 and the lift plate 33 that are arranged in the vicinity of the inner surface of any one of the right side cover, the front cover and the rear cover on the same shaft.

Besides, in the present embodiment, the carry guide 31 that constitutes the both-side carry path 16 is used; however, it is possible to use the carry guide 31 for one-side printing. Besides, in the present embodiment, the coil spring 41 and the eccentric cam 43 are used to rotate the lift plate 33 in the vertical direction; however, the method for rotating the lift plate 33 is not especially limited to the present embodiment, and for example, it is possible to rotate the lift plate 33 in the vertical direction by using a solenoid or the like.

Besides, here, the lift plate 33 is energized from the lower position to the upper position by using the coil spring 41; however, it is possible to pull the lift plate 33 upward by using a tension spring or the like. Besides, the present invention is applicable to various types of copy machines such as a digital copy machine, a tandem-type color copy machine, an analog monochromatic copy machine and the like, or to image forming apparatuses such as a facsimile machine, a laser printer and the like. In addition, the present invention is also applicable to precision devices, electronic devices other than the image forming apparatuses.

Besides, in the above embodiment, in a case where the engagement pawl portion 70*c* bends toward the inner circumferential side to allow the protrusion end portion 70*ca* to engage with and disengage from the engagement portion 62*ba*, it is possible to suitably design the shapes, sizes and the like of the main body portion 70*a*, the flange portion 70*b*, the engagement pawl portion 70*c*, the protrusion end portion 70*ca*, the butt portion 70*d*, and the limit portion 70*e* of the first bearing 70 and the engagement hole 62*ba*.

Besides, in the above embodiment, the rear-side end portion 35*b* of the third shaft 35 is cut into the D shape in section to be inserted into the first through-hole 61*a*; however, the shapes of the rear-side end portion 35*b* and the first through-hole 61*a* are not limited in a case where the rear-side end portion 35*b* is able to be supported by the rear-side wall 61.

Besides, in the above embodiment, the first bearing 70 is mounted on the front-side end portion 35*c* of the third shaft 35; however, it is possible to mount the first bearing 70 on the rear-side end portion 35*b*, and also on both of the front-side and rear-side end portions 35*c* and 35*b*. As described above, in the case where the two first bearings 70 are mounted, in the third embodiment of the bearing, it is possible to support the second engagement portions 10*ba* on the rear side and front side of the manual supply tray 10*b* on the first bearings 70.

Besides, in the above embodiment, the first bearing 70 is mounted on the third shaft 35; however, it is possible to mount the first bearing 70 on another shaft in a case where the shaft is able to be mounted in the apparatus main body and support a rotary member.

According to the present invention, because not only it is possible to achieve the size reduction of the apparatus without complicating the apparatus and with a simple structure, but also the paper-sheet pushing-up plate is able to rotate about the same rotation pivot as that for the side cover and the paper-sheet supply tray, it is possible to enlarge the protrusion length of the paper-sheet pushing-up plate and reduce the change in the inclination angle, so that it is possible to achieve the size reduction of the apparatus main body and stabilize the paper-sheet supply performance. Besides, by supporting the carry guide on the above support shaft, it is possible to achieve further size reduction of the apparatus main body.

Besides, by disposing the ground member that electrically grounds the electrically conductive member that is disposed on the carry guide via the support shaft, it is possible to achieve a reduction in the number of parts and an efficient assembly operation without disposing separately another ground member. Besides, the limit member that limits the opening of the side cover and the carry guide to the predetermined first area is disposed and the side cover and the carry guide are capable of being opened to the second area beyond the first area in response to limitation release of the limit member and freely mounted and demounted on and from the support shaft with opened to the second area, so that an efficient assembly operation is achieved and the maintenance operation also becomes easy.

Besides, because the support shaft is able to be mounted in the apparatus main body with at least one of the paper-sheet supply tray and the paper-sheet pushing-up plate supported on the support shaft, it is possible to achieve an efficient assembly operation. Besides, one end of the support shaft is supported by the apparatus main body and the other end of the support shaft is supported by a bearing member which is mounted from outside of the apparatus main body, and the support shaft is mounted in the apparatus main body with the movements in the shaft direction and the rotation direction limited, so that an efficient assembly operation is achieved and the maintenance operation also becomes easy.

Besides, the support shaft is supported in the apparatus main body by the bearing member; the flange portion, the butt portion and the engagement pawl portion are formed on the main body portion of the bearing member; the protrusion end portion of the engagement pawl portion constitutes part of the flange portion and is capable of engaging with the engagement portion that is formed in the apparatus main body; and the engagement pawl portion bends toward the inner circumferential side of the main body portion in a time the bearing member is mounted on or demounted from the apparatus main body to engage or disengage the protrusion end portion with or from the engagement portion, so that it becomes possible to easily achieve the mounting and demounting on and from the apparatus main body even in a place where it is hard to work without using additional members and tools. Besides, the cost reduction and resource conservation are achieved.

Besides, by forming the limit portion that is capable of limiting the flexure of the engagement pawl portion toward the inner circumferential side, it is possible to prevent the engagement pawl portion from excessively bending to break down when the bearing member is mounted or demounted. Besides, by enlarging the outer diameter of the protrusion end portion from one end portion to the other end portion in the circumferential direction, it is possible to disengage the engagement pawl portion from the engagement portion by only rotating the bearing member in one direction, so that the workability improves. Besides, by allowing the main body portion to rotatably support the side cover, the paper-sheet supply tray, the paper-sheet pushing-up plate or the carry guide, the member is able to be shared, so that it is possible to further reduce the number of parts.

LIST OF REFERENCE NUMERALS

[1.] JP-A-2002-214860
[2.] JP-A-2005-343700
[3.] JP-A-2005-055862
[4.] JP-A-1996-169588

What is claimed is:

1. An image forming apparatus, comprising:

a side cover which constitutes part of an apparatus main body and is rotatably supported at a lower end portion thereof to be freely opened and closed;

a paper-sheet supply tray that is used to place a paper sheet thereon, constitutes part of the side cover, and supported rotatably at a lower end portion thereof to be freely opened and closed from and to the side cover;

a paper-sheet pushing-up plate that is supported rotatably at an upstream end portion in a paper-sheet carry direction thereof, capable of pressurizing and separating the paper sheet placed on the paper-sheet supply tray to and from a paper-sheet carry roller that is disposed in the apparatus main body;

a carry guide that is disposed along an inner surface of the side cover, supported rotatably at a lower end portion thereof, and forms a paper-sheet carry path for guiding upward the paper sheet, which is carried from the paper-sheet supply tray by the paper-sheet carry roller, in a vertical direction;

wherein at least the side cover, the paper-sheet supply tray and the paper-sheet pushing-up plate are supported by a same support shaft and both ends of the paper-sheet pushing-up plate are supported by the support shaft at positions further outward in a longitudinal direction of the support shaft than those of the side cover and the paper-sheet supply tray.

2. The image forming apparatus according to claim 1, wherein the carry guide is supported by the support shaft.

3. The image forming apparatus according to claim 2, wherein the carry guide further comprises on electrically conductive member and a ground member that electrically grounds the electrically conductive member.

4. The image forming apparatus according to claim 2, wherein the side cover and the carry guide are supported to be openable and closable in a first predetermined area with separation from the support shaft with limited rotation and openable to a second area beyond the first area, the side cover and the carry guide being freely mounted and demounted on and from the support shaft when opened to the second area.

5. The image forming apparatus according to claim 1, wherein the support shaft is capable of being mounted in the apparatus main body with at least one of the paper-sheet supply tray and the paper-sheet pushing-up plate mounted on the support shaft.

6. The image forming apparatus according to claim 1, wherein one end of the support shaft is supported by the apparatus main body and the other end of the support shaft is supported by a bearing member which is mounted from outside of the apparatus main body, and the support shaft is mounted in the apparatus main body with movements in a shaft direction and a rotation direction limited.

7. The image forming apparatus according to claim 6, wherein the bearing member includes:

a main body portion that is disposed in the apparatus main body and includes a cylindrical member capable of being freely mounted and demounted in and from a support hole through which the support shaft penetrates;

a flange portion that protrudes from a separation-side end portion of an outer circumferential surface of the main body portion and is capable of limiting movement of the main body portion toward a mounting side of the main body portion;

a butt portion that prevents the support shaft from falling off the main body portion, protrudes from an inner circumferential surface of the main body portion and is capable of butting against one end portion of the support shaft; and an engagement pawl portion that prevents the main body portion from falling off the apparatus main body and is formed along a longitudinal direction of the main body portion by providing cutouts in the main body portion from the flange portion to a central portion substantially in parallel to and a predetermined distance away from each other; wherein a protrusion end portion of the engagement pawl portion constitutes part of the flange portion and is capable of engaging with an engagement portion that is formed in the apparatus main body;

and in a time the bearing member is mounted or demounted on or from the apparatus main body, the engagement pawl portion bends toward an inner circumferential side of the main body portion, so that the protrusion end portion is engaged with or disengaged from the engagement portion.

8. The image forming apparatus according to claim 7, wherein a limit portion that is capable of limiting flexure of the engagement pawl portion toward the inner circumferential side protrudes from the inner circumferential surface of the main body portion.

9. The image forming apparatus according to claim 7, wherein an outer diameter of the protrusion end portion becomes larger from one end portion to the other end portion in a circumferential direction.

10. The image forming apparatus according to claim 7, wherein the main body portion is capable of rotatably supporting the side cover, the paper-sheet supply tray, the paper-sheet pushing-up plate or the carry guide.

* * * * *